US007171939B1

(12) United States Patent
Tiller

(10) Patent No.: US 7,171,939 B1
(45) Date of Patent: Feb. 6, 2007

(54) INTEGRATED CAM DRIVE AND OIL PUMP ASSEMBLY FOR MOTORCYCLE ENGINES AND THE LIKE

(75) Inventor: Timothy T. Tiller, Blue River, WI (US)

(73) Assignee: S&S Cycle, Inc., Viola, WI (US)

( * ) Notice: Subject to any disclaimer, the term of this patent is extended or adjusted under 35 U.S.C. 154(b) by 0 days.

(21) Appl. No.: 11/242,370

(22) Filed: Sep. 30, 2005

(51) Int. Cl.
*F01M 1/02* (2006.01)
*F01L 1/02* (2006.01)
*F01M 1/00* (2006.01)

(52) U.S. Cl. ..... 123/196 R; 123/90.31

(58) Field of Classification Search ..... 123/196 R, 123/90.1, 90.27, 90.31, 90.33, 90.34; 184/6.5, 184/6.28, 27.1
See application file for complete search history.

(56) References Cited

U.S. PATENT DOCUMENTS

| | | | |
|---|---|---|---|
| 4,550,698 | A | 11/1985 | Konneker |
| 4,606,310 | A | 8/1986 | Makino |
| 4,688,523 | A | 8/1987 | Takahashi et al. |
| 4,690,236 | A | 9/1987 | Shinozaki et al. |
| 4,703,724 | A | 11/1987 | Candea et al. |
| 4,736,809 | A | 4/1988 | Kumazawa |
| 5,025,673 | A | 6/1991 | Yamada |
| 5,070,830 | A | 12/1991 | Malven et al. |
| 5,092,292 | A | 3/1992 | Iguchi et al. |
| 5,295,463 | A | 3/1994 | Wenger et al. |
| 5,485,101 | A | 1/1996 | Hynes |
| 5,495,833 | A | 3/1996 | Ishizaka et al. |
| 5,555,856 | A | 9/1996 | Bauer et al. |
| 5,937,817 | A | 8/1999 | Schanz et al. |
| 6,047,667 | A | 4/2000 | Leppanen et al. |
| 6,085,855 | A | 7/2000 | Schanz et al. |
| 6,241,040 | B1 | 6/2001 | Schanz et al. |

FOREIGN PATENT DOCUMENTS

| | | |
|---|---|---|
| DE | 1213164 | 3/1966 |
| DE | 1225061 | 9/1966 |

OTHER PUBLICATIONS

Netbikes Motorcycle, "Vintage Motorcycle Road Tests Royal Enfield Meteor Minor De Luxe," www.netbikes.com.au, Before Aug. 2000, 5 pages, Internet.

(Continued)

*Primary Examiner*—Noah P. Kamen
(74) *Attorney, Agent, or Firm*—Price, Heneveld, Cooper, DeWitt & Litton, LLP

(57) ABSTRACT

An integrated cam drive and oil pump assembly for motorcycle engines includes an oil pump body, which is connected with the engine crankcase, and has an oil passageway with a pump outlet portion communicating with an oil reservoir. A pinion gear is positioned in the interior of the oil pump body, is connected with the engine drive shaft for rotation therewith, and mates with an idler gear. A first cam drive gear is mounted on a first camshaft, and mates with the idler gear. A second cam drive gear is mounted on the first camshaft in an axially spaced relationship with the first cam drive gear. A third cam drive gear is mounted on a second camshaft, and mates with the second cam drive gear. A cam chest return gear has a first portion extending into the cam chest sump to draw oil therefrom, and a second portion mating with the idler gear adjacent the pump outlet portion of the oil passageway, such that oil drawn from the cam chest sump by the cam chest return gear flows from the cam chest sump, through the oil passageway, and into the oil reservoir.

50 Claims, 23 Drawing Sheets

OTHER PUBLICATIONS

Custom Chrome, "For Softtail Models," Custom Chrome Catalog, 1994, p. 170.
Unknown, "Transmission Housing and Transmission Housing & Oil Tank-Flt," 1340 Models Parts Catalog, 1993 and 1994, pp. 44 & 48.
Harley-Davidson, "Transmission Case/Oil Pan," Flt Models Harley-Davidson 1995-1996 Official Factory Manual, 1995-1996, 3 pages.
AJS Motorcycles Ltd, "Stormer Motocross," Y4 Engine 250cc & Gearbox, and related photos and drawings, Date Unknown, 12 pages.
V-Twin Manufacturing Brand Products, "2003 Uniquely V-Twin Manufacturing Product Reference Guide," 2003, 4 pages.
Feuling Motor Company, "2005 Catalogue Drag Specialties Power Twins," 2005, 4 pages.
J&P Cycles, "J&P Cycles Keeping The World On 2 Wheels 2005 Parts & Accessories For Harley-Davidson Motorcycles 1936-2005," 2005, 6 pages.
W&W World Wide Cycles, "Eat Dust-Serious Parts For Serious Harley Riders," 2005 edition, 2005, 4 pages.
Feuling Motor Company, "Feuling Super Pump-The Ultimate Oil Pump For Twin Cam Engines," Date Unknown, 2 pages.
Vulcan USA, "Billet Pro Series II #3863," Date Unknown. 2 pages.
Biker's Choice, "Biker's Choice 2002 Handbook—Quality Apparel And Accessories For The American Motorcycle Experience," 2002, 6 pages.
Custom Chrome/Chrome Specialties, "Custom Chrome Chrome Specialties World's Finest Products For Harley-Davidson 2003," 2003, 3 pages.

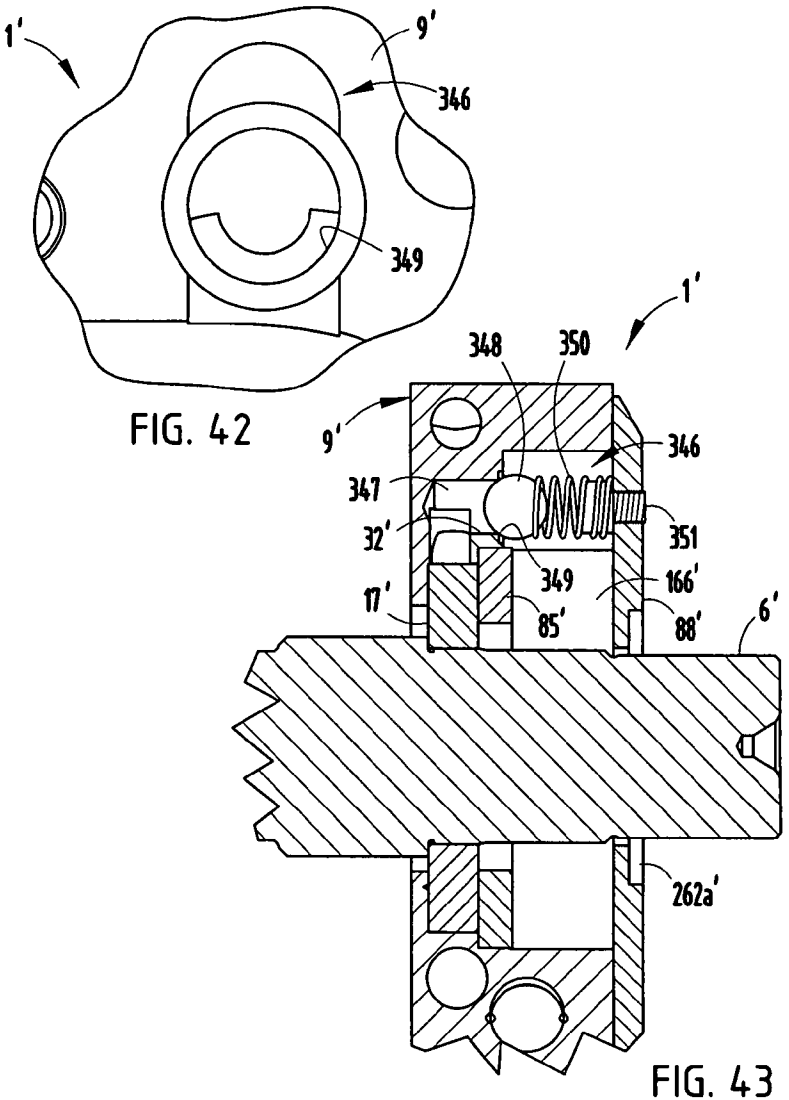
FIG. 42
FIG. 43
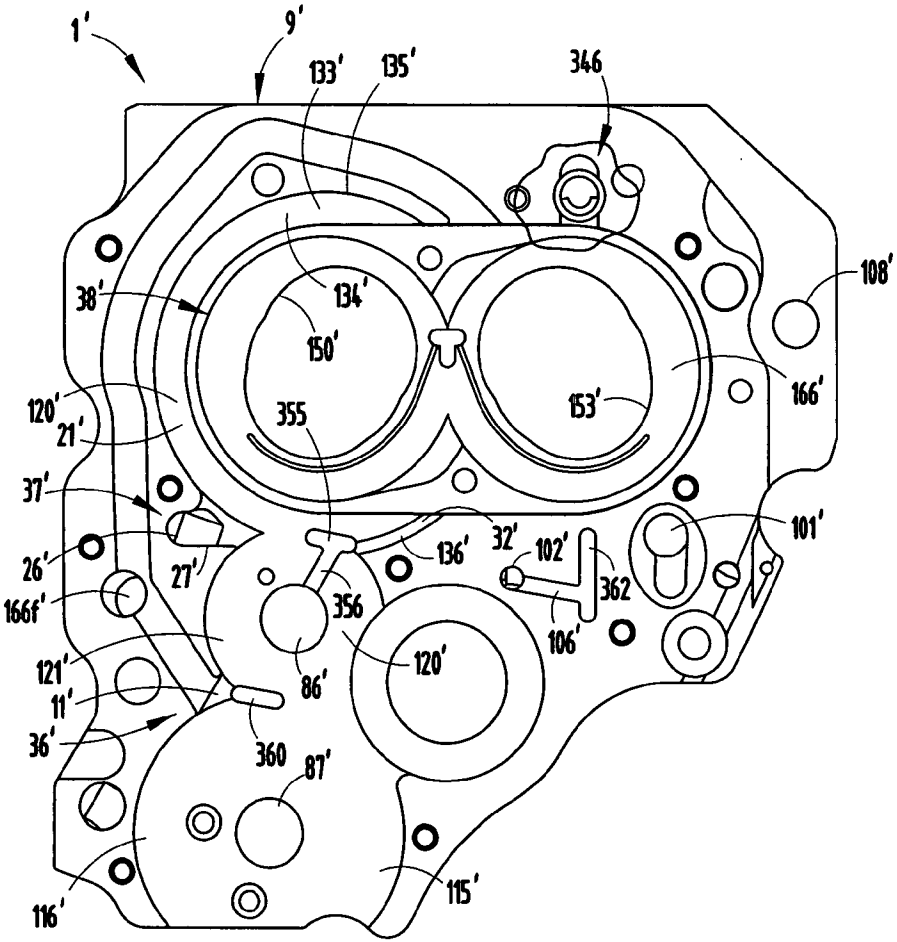
FIG. 41

INTEGRATED CAM DRIVE AND OIL PUMP ASSEMBLY FOR MOTORCYCLE ENGINES AND THE LIKE

BACKGROUND OF THE INVENTION

The present invention relates to engines for motorcycles and the like, and in particular to an oil pump assembly and related method therefor.

Twin cam style engines are well known in the motorcycle industry, and employ two separate camshafts to control the valve trains for two cylinder motorcycle engines, such as that disclosed in U.S. Patent Document 2004/0159496. Some twin cam style motorcycle engines, such as those disclosed in U.S. Pat. Nos. 6,047,667 and 6,116,205, drive the two camshafts with a chain drive arrangement. However, for high performance motorcycle engines, a gear drive arrangement for the camshafts is normally preferred, so as to improve valve timing accuracy by eliminating timing chain lash, and variations caused by loose fittings between the drive chain and associated drive chain sprockets. Such gear drive systems result in more horsepower by eliminating chain drag, permit more aggressive cam profiles that result in additional valve lift, and also permit increased valve spring force to be used in the engine heads.

Furthermore, twin cam style motorcycle engines, such as those disclosed in U.S. Pat. Nos. 6,047,667 and 6,116,205, are typically equipped with two or more separate gerotor-type pumps to circulate oil through the engine and to and from a remote oil reservoir. These types of oil pump arrangements add additional complexity and cost to the engine construction, and generally detract from the type of compact engine design usually preferred by motorcycle manufacturers.

SUMMARY OF THE INVENTION

One aspect of the present invention is an integrated cam drive and oil pump assembly in combination with a motorcycle engine having a crankcase, a drive shaft, first and second camshafts, a cam chest sump, and an oil reservoir. The integrated cam drive and oil pump assembly comprises an oil pump body operably connected with the crankcase, and including an oil passageway having a pump outlet portion thereof communicating with the oil reservoir, and a generally open interior receiving the drive shaft therein. A drive gear is disposed in the interior of the oil pump body, and is operably connected with the drive shaft for rotation therewith. An idler gear is rotatably supported in the interior of the oil pump body, and matingly engages the drive gear for rotation therewith. A first cam drive gear is disposed in the interior of the oil pump body, is operably connected with the first camshaft for rotation therewith, and matingly engages the idler gear to axially rotate the first camshaft. A second cam drive gear is operably connected with the first camshaft at a location spaced axially apart from the first cam drive gear, and rotates with the first camshaft. A third cam drive gear is operably connected with the second camshaft for rotation therewith, and matingly engages the second cam drive gear to axially rotate the second camshaft. A cam chest return gear is rotatably supported in the interior of the oil pump body, and has a first portion thereof extending into a portion of the cam chest sump to draw oil therefrom, and a second portion thereof matingly engaging the idler gear at a location adjacent to the pump outlet portion of the oil passageway, such that oil drawn from the cam sump by the cam chest return gear is displaced between the cam chest return gear and the idler gear to flow the oil from the cam chest sump, through the oil passageway, and into the oil reservoir.

Another aspect of the present invention is an integrated cam drive and oil pump assembly for a motorcycle engine of the type having a crankcase, a drive shaft, a cam chest sump, and an oil reservoir. The integrated cam drive and oil pump assembly comprises an oil pump body adapted for operable connection with the crankcase, and including an oil passageway having a pump outlet portion thereof communicating with the oil reservoir, and a generally open interior configured to receive the drive shaft therein. A drive gear is disposed in the interior of the oil pump body, and is adapted for operable connection with the drive shaft for rotation therewith. An idler gear is rotatably supported in the interior of the oil pump body, and matingly engages the drive gear for rotation therewith. The cam drive and oil pump assembly further includes first and second camshafts, as well as a first cam drive gear disposed in the interior of the oil pump body, operably connected with the first camshaft for rotation therewith, and matingly engaging the idler gear to axially rotate the first camshaft. A second cam drive gear is operably connected with the first camshaft at a location spaced axially apart from the first cam drive gear, and rotates with the first camshaft. A third cam drive gear is operably connected with the second camshaft for rotation therewith, and matingly engages the second cam drive gear to axially rotate the second camshaft. A cam chest return gear is rotatably supported in the interior of the oil pump body, and has a first portion thereof extending into a portion of the cam chest sump to draw oil therefrom, and a second portion thereof matingly engaging the idler gear at a location adjacent to the pump outlet portion of the passageway, such that oil drawn from the cam chest sump by the cam chest return gear is displaced between the cam chest return gear and the idler gear to flow the oil from the cam chest sump, through the oil passageway, and into the oil reservoir.

Yet another aspect of the present invention is an oil pump kit for a motorcycle engine of the type having a crankcase, a drive shaft, at least one camshaft, a cam chest sump, and an oil reservoir. The kit comprises an oil pump body adapted for operable connection with the crankcase, and including an oil passageway having a pump outlet portion thereof communicating with the oil reservoir, and a generally open interior configured to receive the drive shaft therein. The kit also includes a drive gear disposed in the interior of the oil pump body, and adapted for operable connection with the drive shaft for rotation therewith, as well as an idler gear rotatably supported in the interior of the oil pump body, and matingly engaging the drive gear for rotation therewith. The kit further includes a cam drive gear disposed in the interior of the oil pump body, adapted for operable connection with the camshaft for rotation therewith, and matingly engaging the idler gear to axially rotate the camshaft. The kit also includes a cam chest return gear which is rotatably supported in the interior of the oil pump body, and has a first portion thereof extending into a portion of the cam chest sump to draw oil therefrom, and a second portion thereof matingly engaging the idler gear at a location adjacent to the pump outlet portion of the oil passageway, such that oil drawn from the cam chest sump by the cam chest return gear is displaced between the cam chest return gear and the idler gear to flow the oil from the cam chest sump, through the oil passageway, and into the oil reservoir.

Yet another aspect of the present invention is an improvement for a motorcycle engine of the type having a crankcase, a drive shaft, a cam chest sump, and an oil reservoir. The improvement comprises an oil pump body operably connected with the crankcase, and including an oil passageway having a pump outlet portion thereof communicating with the oil reservoir, a generally open interior configured to receive the drive shaft therein, and a recess defined by a sidewall having an open bottom portion. A drive gear is disposed in the interior of the oil pump body, and is operably connected with the drive shaft for rotation therewith. An idler gear is rotatably supported in the interior of the oil pump body, and matingly engages the drive gear for rotation therewith. A cam chest return gear is closely received in the recess, and has a first portion thereof protruding through the open bottom portion of the sidewall and into a portion of the cam chest sump to draw oil therefrom, and a second portion thereof matingly engaging the idler gear at a location adjacent to the pump outlet portion of the oil passageway, such that oil is drawn directly from the cam chest sump by the cam chest return gear without requiring an inlet port, and is displaced between the cam chest return gear and the idler gear to flow the oil directly from the cam chest sump, through the oil passageway, and into the oil reservoir.

Yet another aspect of the present invention is an integrated cam drive and oil pump assembly in combination with a motorcycle engine of the type having a crankcase, a drive shaft, at least one camshaft, a crankcase sump, and an oil reservoir. The integrated cam drive and oil pump assembly comprises an oil pump body operably connected with a crankcase, and including an oil passageway having a pump outlet portion thereof communicating with the oil reservoir, and a generally open interior receiving the drive shaft therein. A drive gear is disposed in the interior of the oil pump body, and is operably connected with the drive shaft for rotation therewith. An idler gear is rotatably supported in the interior of the oil pump body, and matingly engages the drive gear for rotation therewith. A first cam drive gear is disposed in the interior of the oil pump body, and is operably connected with the first camshaft for rotation therewith, and matingly engages the idler gear to rotate the first camshaft. The pump outlet portion of the oil passageway is disposed adjacent to matingly engaged portions of the idler gear and the first cam drive gear to convey oil from the crankcase sump and displace the oil between the idler gear and the first cam drive gear to flow the oil from the crankcase sump, through the oil passageway, and into the oil reservoir.

Yet another aspect of the present invention is an integrated cam drive and oil pump assembly in combination with a motorcycle engine of the type having a crankcase, a drive shaft, first and second camshafts, a cam chest sump, and an oil reservoir. The integrated cam drive and oil pump assembly comprises an oil pump body operably connected with the crankcase, and including an oil passageway having a pump inlet portion thereof communicating with the oil reservoir, and a generally open interior receiving the drive shaft therein. A drive gear is disposed in the interior of the oil pump body, and is operably connected with the drive shaft for rotation therewith. An idler gear is rotatably supported in the interior of the oil pump body, and matingly engages the drive gear for rotation therewith. A first cam drive gear is disposed in the interior of the oil pump body, is operably connected with the first camshaft for rotation therewith, and matingly engages the idler gear to axially rotate the first camshaft. A second cam drive gear is operably connected with the first camshaft at a location spaced axially apart from the first cam drive gear, and rotates with the first camshaft. A third cam drive gear is operably connected with the second camshaft for rotation therewith, and matingly engages the second cam drive gear to axially rotate the second camshaft. The oil pump body includes an inlet pocket communicating with the oil reservoir, and disposed adjacent to matingly engaged portions of the second cam drive gear and the third cam drive gear at a diverging side thereof to draw oil from the oil reservoir and displace the oil between the second and third cam drive gears to flow the oil throughout the engine.

Yet another aspect of the present invention is a method for making a motorcycle engine of the type having a crankcase, a drive shaft, first and second camshafts, a cam chest sump, and an oil reservoir. The method includes providing an oil pump body with an oil passageway having a pump outlet portion thereof and a generally open interior, and operably connecting the oil pump body with the crankcase, such that the drive shaft is positioned in the interior of the oil pump body. The pump outlet portion of the oil passageway is communicated with the oil reservoir. The method further includes providing a drive gear, and mounting the drive gear in the interior of the oil pump body, and operably connecting the same with the drive shaft for rotation therewith. The method further includes providing an idler gear, and rotatably supporting the idler gear in the interior of the oil pump body, and matingly engaging the same with the drive gear for rotation therewith. The method further includes providing a first cam drive gear, and operably connecting the first cam drive gear with the first camshaft for rotation therewith in the interior of the oil pump body, and matingly engaging the first cam drive gear with the idler gear to axially rotate the first camshaft. The method further includes providing a second cam drive gear, and operably connecting the second cam drive gear with the first camshaft at a location spaced axially apart from the first cam drive gear for rotation with the first camshaft. The method further includes providing a third cam drive gear, and operably connecting the third cam drive gear with the second camshaft for rotation therewith in the interior of the oil pump body, and matingly engaging the third cam drive gear with the second cam drive gear to axially rotate the second camshaft. The method also includes providing a cam chest return gear, and rotatably supporting the cam chest return gear in the interior of the oil pump body, and extending a first portion thereof into a portion of the cam chest sump to draw oil therefrom, and positioning a second portion thereof in mating engagement with the idler gear at a location adjacent to the pump outlet portion of the oil passageway, such that oil drawn from the cam chest sump by the cam chest return gear is displaced between the cam chest return gear and the idler gear to flow oil from the cam chest sump, through the oil passageway, and into the oil reservoir.

Yet another aspect of the present invention provides an integrated cam drive and oil pump assembly having a relatively uncomplicated design that is efficient in use, economical to manufacture, capable of a long operating life, and particularly well adapted for the proposed use. The integrated cam drive and oil pump assembly is particularly adapted for use in high performance motorcycle engines, and adapts the associated cam drive gear trains to perform oil pumping operations which take the place of separate gerotor-type or other similar oil pumps, and provides a more positive type of oil pump displacement, which improves oil supply to the engine, and also improves the scavenging of oil from the cam chest and crankcase. The integrated cam drive and oil pump also includes a functional billet gear cover that supports the ends of the camshaft, and also provides a unique appearance to the engine. The integrated cam drive and oil pump assembly also regulates oil pressure after the filter to provide more consistent pressure through a wide range of engine temperatures and environments, such as cold starts, filter obstructions, etc., such that oil pressure to the various lubricated engine parts remains virtually the same at all times. The integrated cam drive and oil pump assembly can provide larger volumes of oil than stock oil pumps, which permit it to better maintain oil pressure under various conditions, such as hot idle and cold start. For example, at hot idle, the integrated cam drive and oil pump assembly will maintain a higher pressure, but at highway speed, the pressure will not be higher than stock, since there is no advantage to increasing the hot running oil pressure because elevated pressures will only increase the likelihood of oil leaks and the volume of oil that needs to be scavenged from the crankcase. A larger volume of oil in the crankcase also decreases power due to increased drag on the flywheels, and also increases the amount of heat generated as the flywheels plow through the extra oil. Since the integrated cam drive and oil pump assembly has a larger capacity to deliver oil volume, the same can maintain steady oil pressure even under the most demanding circumstances. Furthermore, the increased scavenging capacity of the integrated cam drive and oil pump assembly will pump more oil out of the engine and back to the oil reservoir, so as to reduce the problems associated with lost power and heat buildup due to excess oil in the crankcase. Furthermore, the integrated cam drive and oil pump assembly reduces oil carryover or blow by.

These and other advantages of the invention will be further understood and appreciated by those skilled in the art by reference to the following written specification, claims and appended drawings.

BRIEF DESCRIPTION OF THE DRAWINGS

FIG. 41 is a front elevational view of an alternate oil pump body portion of the present invention, which includes a pressure relief valve.

FIG. 42 is an enlarged, fragmentary view of the pressure relief valve.

FIG. 43 is an enlarged, fragmentary, horizontal cross-sectional view of the pressure relief valve.

DETAILED DESCRIPTION OF THE PREFERRED EMBODIMENTS

Figure 1:
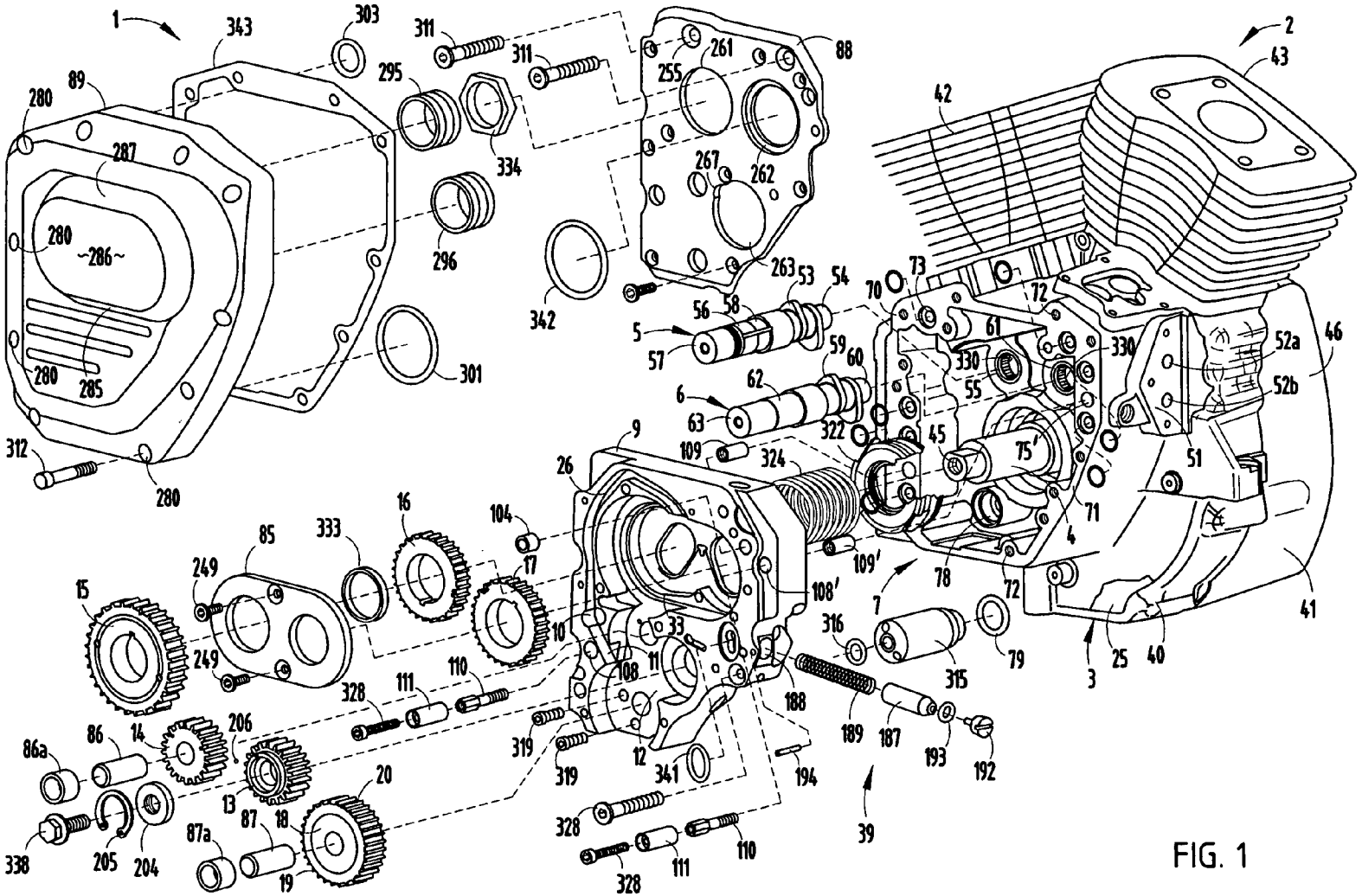
FIG. 1 is an exploded perspective view of an integrated cam drive and oil pump assembly embodying the present invention, shown in combination with an associated motorcycle engine.

For purposes of description herein the term "upper", "lower", "right", "left", "rear", "front", "vertical", "horizontal", and derivatives thereof shall relate to the invention as oriented in FIG. 1, installed in an associated motorcycle, and relative to a seated rider. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
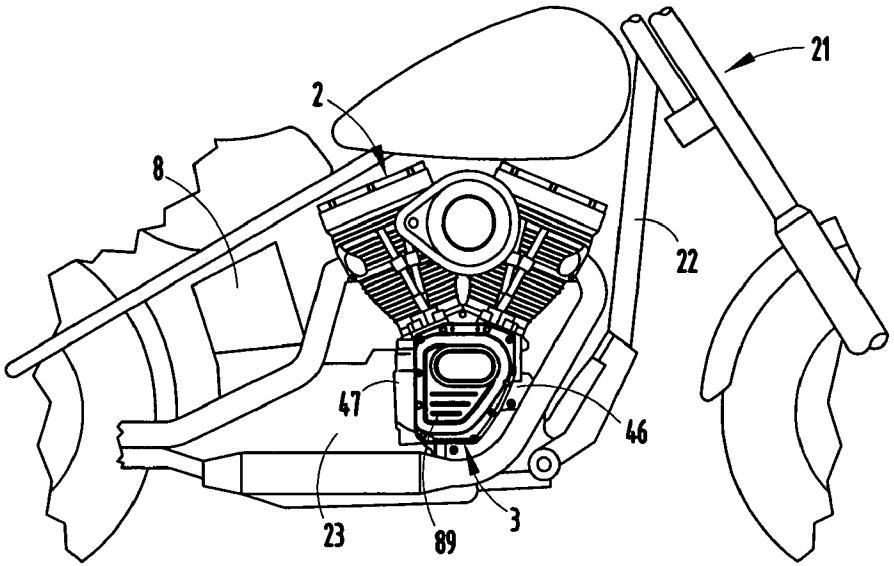
FIG. 2 is a side elevational view of the motorcycle engine, shown installed in a schematic representation of a motorcycle.
Figure 3:
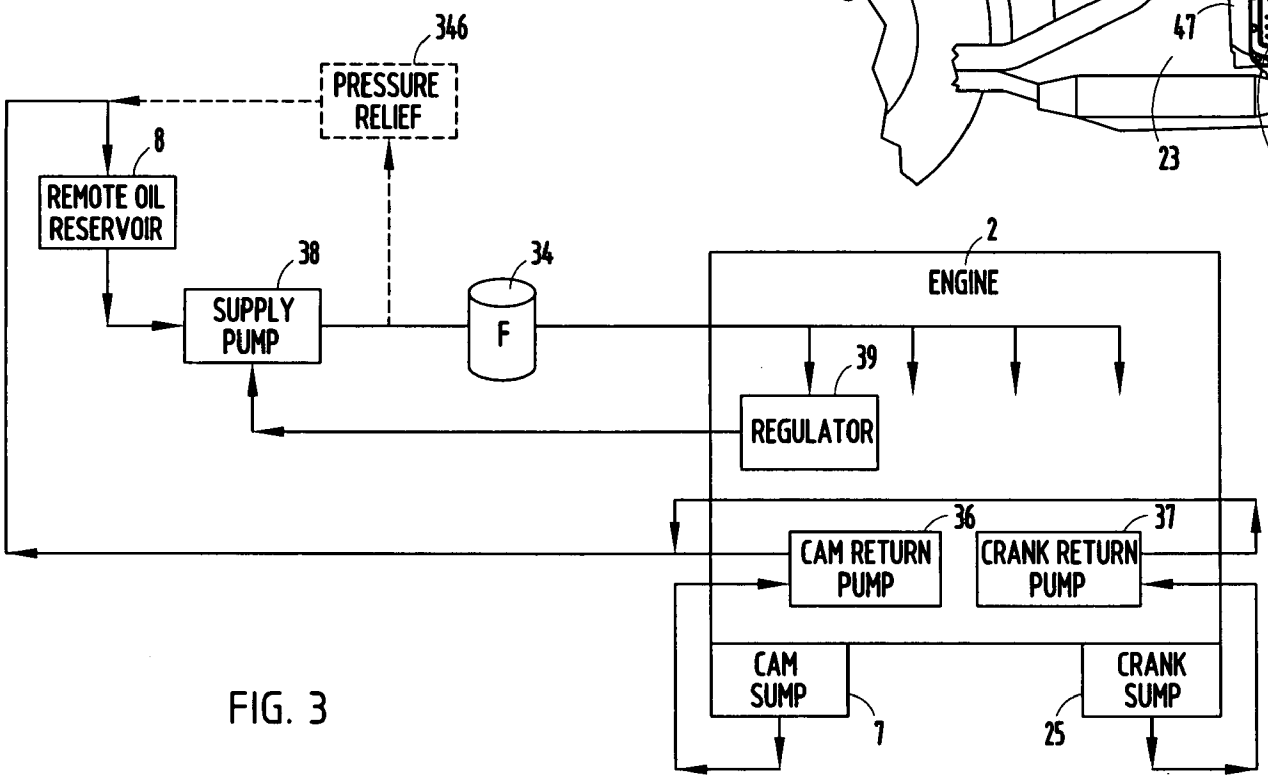
FIG. 3 is a schematic illustration of lubricating oil flow for the integrated cam drive and oil pump assembly and associated motorcycle engine.

The reference numeral 1 (FIG. 1) generally designates an integrated cam drive and oil pump assembly embodying the present invention, which is particularly adapted for use in conjunction with motorcycle engines, such as the partial twin cam style engine 2 shown in FIG. 1, having a crankcase 3, a drive or pinion shaft 4, rear and front camshafts 5 and 6, a cam chest sump 7, and an oil reservoir 8 (FIGS. 2 and 3). Oil pump assembly 1 includes an oil pump body 9 (FIG. 1) which is operably connected with crankcase 3, and includes an oil passageway 10 (FIGS. 1 and 4) with a pump outlet portion 11 thereof communicating with oil reservoir 8, and a generally open interior 12 receiving pinion shaft 4 therein. A drive or pinion gear 13 is rotatably supported in the interior 12 of oil pump body 9, and is operably connected with pinion shaft 4 for rotation therewith. An idler gear 14 is rotatably supported in the interior 12 of oil pump body 9, and matingly engages pinion gear 13 for rotation therewith. A first cam drive gear 15 is disposed in the interior 12 of oil pump body 9, and is operably connected with the rear camshaft 5 for rotation therewith, and matingly engages idler gear 14 to axially rotate rear camshaft 5. A second or rear cam drive gear 16 (FIGS. 1 and 5) is operably connected with rear camshaft 5 at a location spaced axially apart from first cam drive gear 15, and rotates with first camshaft 5. A third or front cam drive gear 17 is connected with the front camshaft 6 for rotation therewith, and matingly engages rear cam drive gear 16 to axially rotate the front camshaft 6. A cam chest return gear 18 (FIGS. 1, 4 and 5) is rotatably supported in the interior 12 of oil pump body 9, and has a first portion 19 extending into a portion of cam chest sump 7 to draw lubricating oil therefrom, and a second portion 20 matingly engaging idler gear 14 at a location adjacent to the pump outlet portion 11 of oil passageway 10, such that oil drawn from cam chest sump 7 by cam chest return gear 18 is displaced between cam chest return gear 18 and idler gear 14 to flow the oil from cam chest sump 7, through oil passageway 10, and into oil reservoir 8 in the manner shown schematically in FIG. 3.

In the illustrated example, motorcycle engine 2 also includes a crankcase sump or flywheel cavity 25 (FIG. 3) which collects oil from the associated lubricated engine parts. Oil pump body 9 further includes a crankcase sump scavenge passageway 26 (FIG. 4) having a pump inlet portion 27 communicating with oil reservoir 8, and a pump outlet portion 28 disposed adjacent to the matingly engaged portions of idler gear 14 and first cam drive gear 15 at the converging side thereof to draw oil from crankcase sump 25 around first cam drive gear 15, and displace the same between idler gear 14 and first cam drive gear 15 to flow the oil from crankcase sump 25, through a portion of oil passageway 10, and into oil reservoir 8 in the manner shown schematically in FIG. 3. Oil from crankcase sump 25 is also drawn around idler gear 14, and displaced between idler gear 14 and cam chest return gear 18 to flow the same to oil reservoir 8 through a portion of oil passageway 10.

Figure 5:
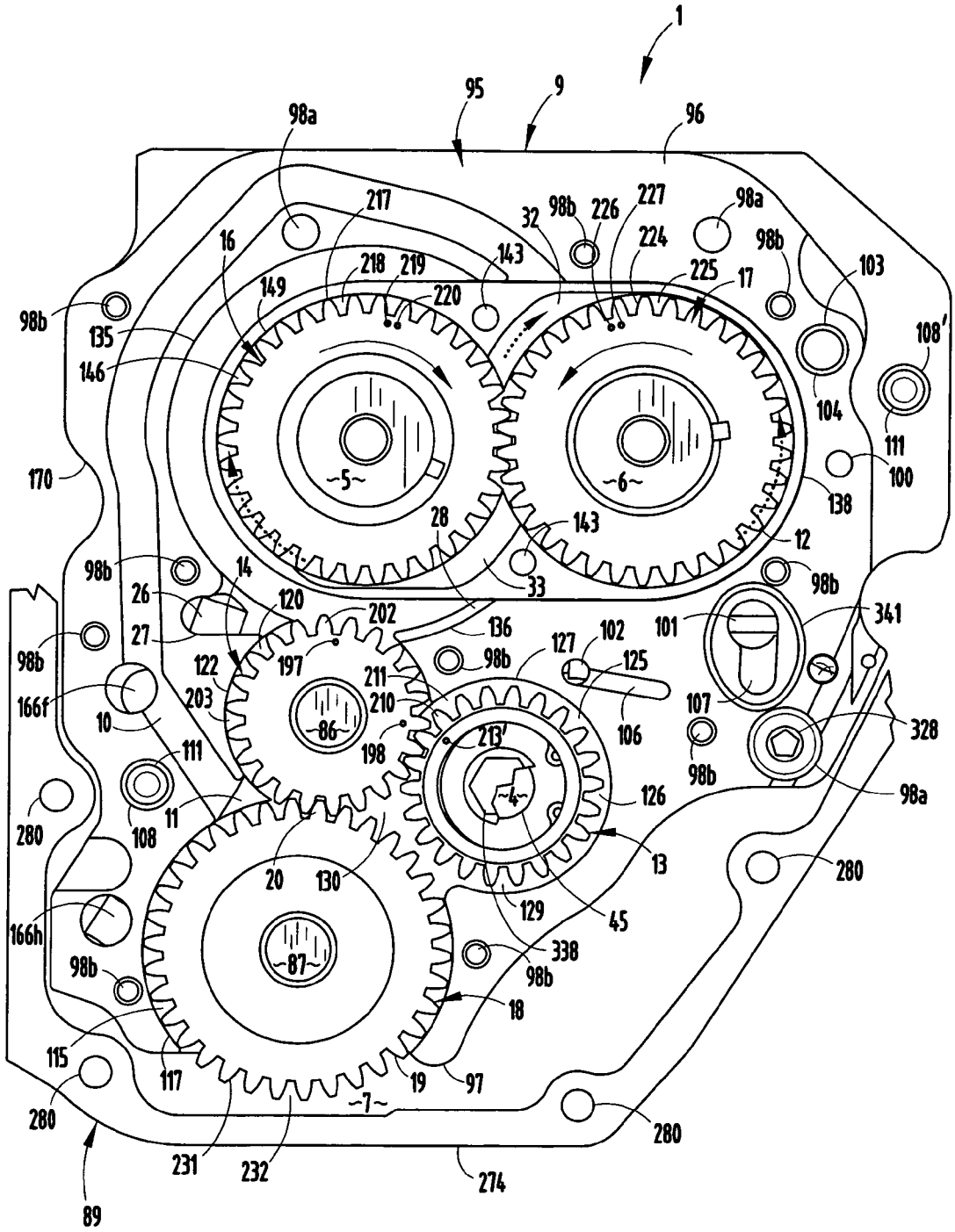
FIG. 5 is an enlarged, partially schematic view of a supply portion of the integrated cam drive and oil pump assembly.

In the illustrated oil pump assembly 1, oil pump body 9 further includes an inlet pocket 33 (FIG. 5), which communicates with oil reservoir 8, and is disposed adjacent to the matingly engaged portions of rear cam drive gear 16 and front cam drive gear 17 at the diverging side thereof, as shown in FIG. 5, to draw oil in pocket 33, around rear cam drive gear 16, and displace the same between the rear and front cam drive gears 16 and 17 to flow lubricating oil from the reservoir 8, through a filter 34, and back to engine 2 to provide supply oil to the lubricated engine parts in the manner shown schematically in FIG. 3.

Hence, as described in greater detail hereinafter, pinion gear 13, idler gear 14, and cam drive gears 15–17 not only drive camshafts 5 and 6 to control the valves, but also define oil pumps which scavenge oil from cam chest sump 7 and crankcase sump or flywheel cavity 25, and provide filtered supply oil to the various engine parts, such as the crank bearings, piston pins, piston coolers, valve lifters, cam bearings, etc.

FIGS. 2 and 3 are schematic illustrations of integrated cam drive and oil pump assembly 1, engine 2, oil reservoir 8, and oil filter 34. In general, oil pump assembly 1 includes a cam chest sump scavenge pump 36, formed in part by intermeshed gears 14 and 18, which flows lubricating oil from cam chest sump 7 back to reservoir 8, and a crankcase scavenge pump 37, formed in part by intermeshed gears 14, 15 and 18, which flows lubricating oil from crankcase sump 25 to reservoir 8, as shown by the arrows in FIGS. 2 and 3. Integrated cam drive and oil pump assembly 1 also includes a feed or supply pump 38, formed in part by intermeshed gears 16 and 17, which draws lubricating oil from reservoir 8, and displaces the same to flow lubricating oil through filter 34 and the various lubricated parts of engine 2. An oil pressure regulator or controller 39 communicates with the engine supply oil and is disposed operably between the outlet and inlet sides of feed pump 38 to control the supply oil pressure in engine 2. Oil reservoir 8 may be mounted at various locations on motorcycle 21, including under transmission 23, or over transmission 23, as shown in FIG. 2. An alternative embodiment of the present invention, as disclosed herein, includes a pressure relief valve mechanism 346 positioned operatively between supply pump 38 and oil reservoir 8, and is shown in broken lines in FIG. 3.

Figure 7:
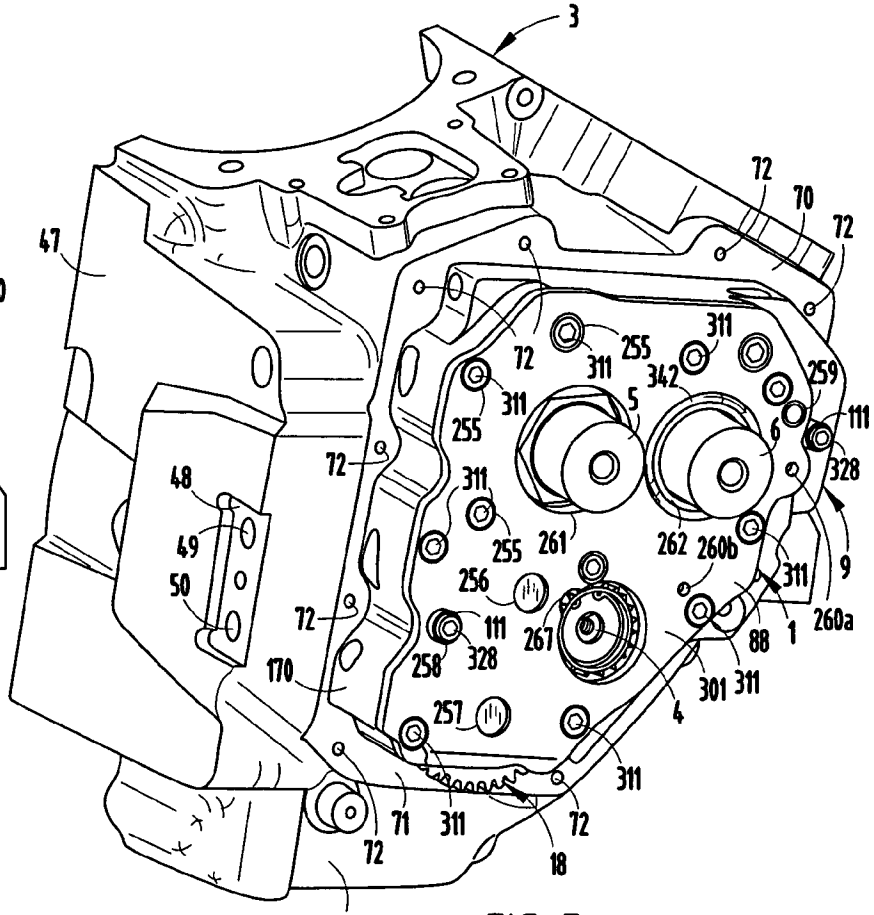
FIG. 7 is a front elevational view of the crankcase shown with the integrated cam drive and oil pump assembly installed thereon, and a cover portion removed to reveal internal construction.
Figure 6:
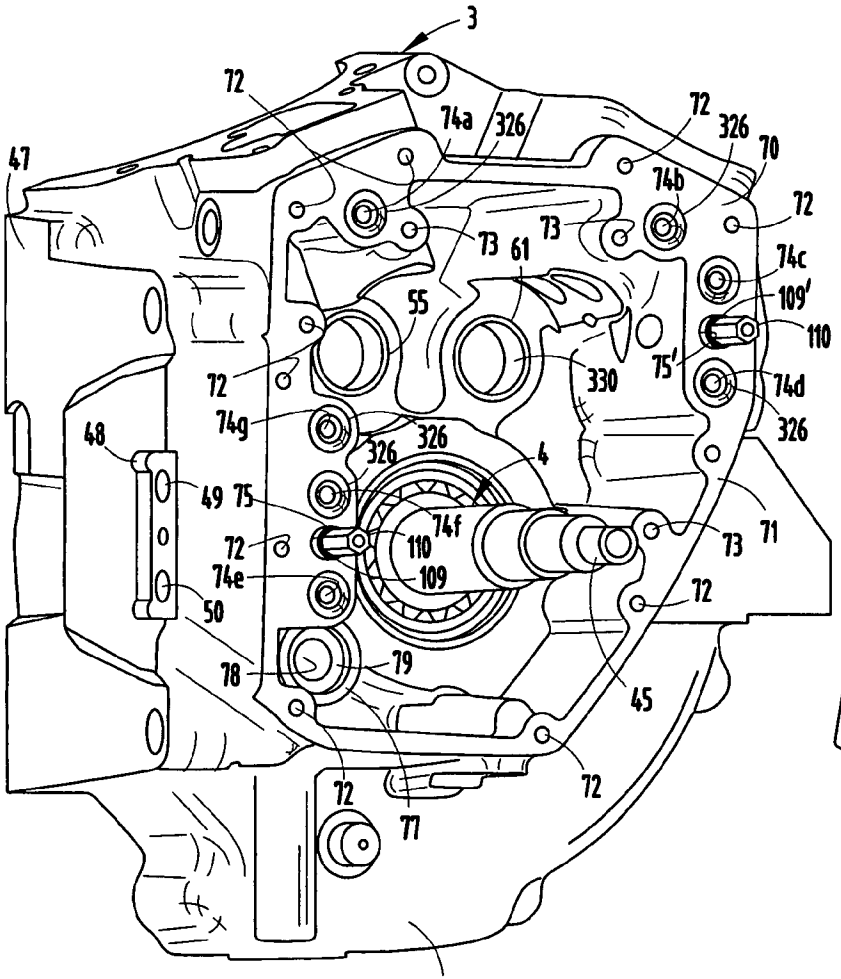
FIG. 6 is a front perspective view of a crankcase portion of the motorcycle engine, prior to assembly of the integrated cam drive and oil pump assembly.
Figure 7A:
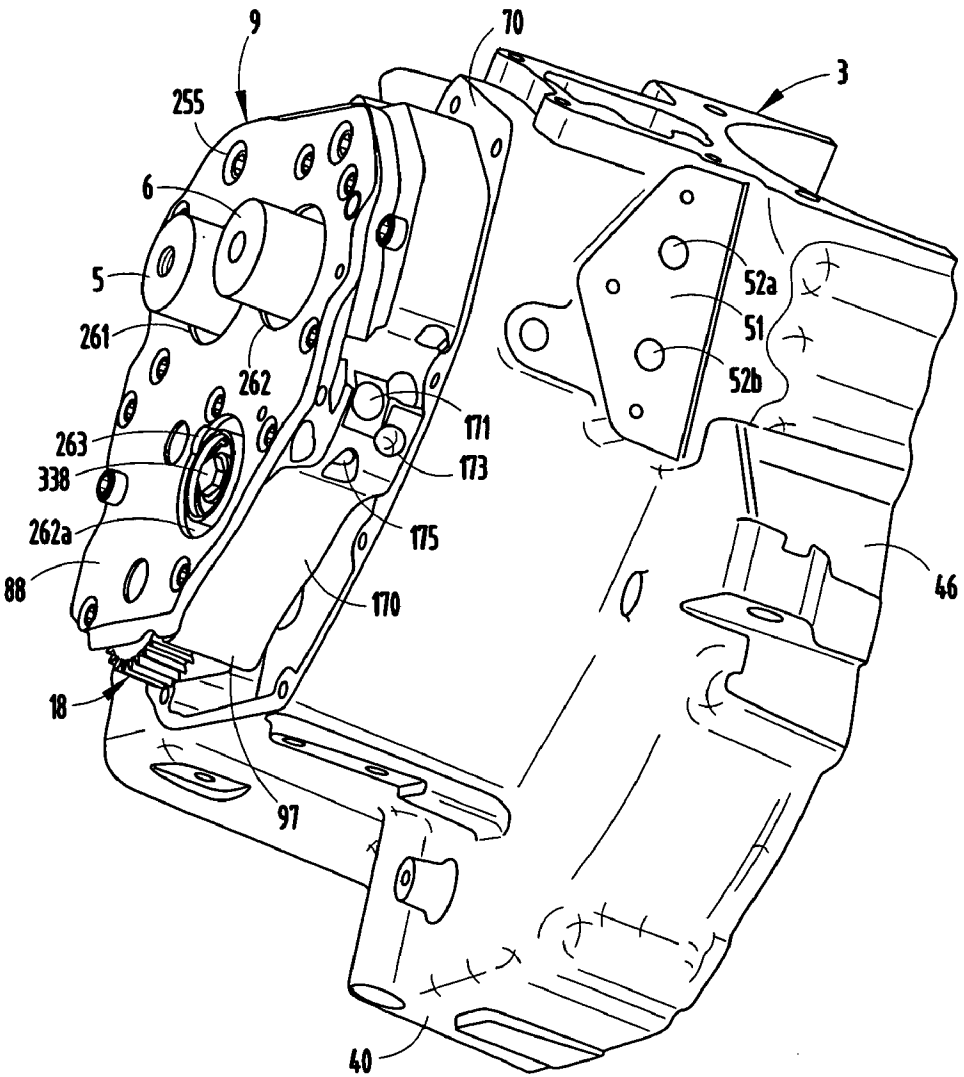
FIG. 7A is a front perspective view of the crankcase and oil pump assembly portion shown in FIG. 7, taken from an opposite side thereof.

The illustrated partial engine 2 (FIG. 1) is a twin cam style motorcycle engine of the type disclosed in related pending U.S. application Ser. No. 10/368,283, which is hereby incorporated herein by reference. More specifically, in the illustrated partial engine 2, crankcase 3 has a two-piece construction, comprising right half 40 and left half 41, which are bolted together in a conventional fashion. Cylinders 42 and 43 are mounted on top of crankcase 3 and house two associated cylinders and pistons (not shown) disposed at a predetermined angle to impart to the engine a characteristic "V" profile. Drive or pinion shaft 4 extends laterally through an associated aperture and bearing in the right half 40 of crankcase 3 in the manner illustrated in FIG. 1, and includes a shouldered noncircular outer end 45. With reference to FIG. 2, the forward portion 46 of crankcase 3 is mounted on an associated frame portion 22 of motorcycle 21, and the rearward portion 47 of crankcase 3 forms a mount for an associated transmission 23, which is shown schematically in FIG. 2. The illustrated oil reservoir 8 is mounted remotely from engine 2 at a location generally rearward thereof on frame 22. As best illustrated in FIGS. 6 and 7, the right half 40 of crankcase 3 at the rearward portion 47 includes a pad 48 with lubrication ports 49 and 50, which serve to route oil between engine 2 and oil reservoir 8 in the manner discussed below. Furthermore, the right half 40 of crankcase 3 (FIG. 7A) at the forward portion 46 thereof includes a pad 51 with an oil port 52*a* for filtered supply oil, and an oil port 52*b* for routing supply oil from the feed or supply pump 38 to the oil filter 34.

The illustrated camshafts 5 and 6 (FIG. 1) are particularly adapted for use in conjunction with engine 2 and associated integrated cam drive and oil pump assembly 1. In the illustrated example, rear camshaft 5 has a substantially cylindrical shape with a pair of lobes 53 projecting radially therefrom. The left-hand end 54 of rear camshaft 5 is rotatably received in a bearing 330, which is mounted in a mating aperture 55 in crankcase 3, as best shown in FIGS. 1 and 6. The central portion of rear camshaft 5 includes a cylindrical mounting surface 56 on which first cam drive gear 15 is supported adjacent outer end 57, and a second mounting surface 58 on which second cam drive gear 16 is supported. Front camshaft 6 is similar to rear camshaft 5, and includes radially extending lobes 59, and a left-hand end 60 mounted in a bearing 330, which is mounted in a mating aperture 61 in crankcase 3, as well as a mounting surface 62 to mount third cam drive gear 17 opposite a free or outer end 63. Camshafts 5 and 6 are disposed in a substantially parallel orientation, and rotate in a synchronous fashion to control the valve trains associated with engine 2.

With reference to FIGS. 6 and 7, oil pump body 9 attaches to the outer or right-hand face 70 of the right half 40 of crankcase 3. Face 70 is defined by a marginal rim 71 having ten threaded fastener apertures 72 spaced apart along rim 71 to mount a cover 89 to crankcase 3. The face 70 of crankcase rim 71 also has three threaded fastener apertures 73, and two, threaded, thread adapter apertures 75, 75' to mount body 9 to crankcase 3, as described in greater detail below. A plurality of oil ports 74*a*–74*g* are also positioned along the rim 71 of crankcase face 70 to route oil between oil reservoir 8 and engine 2, and through engine 2. More specifically, oil ports 74*a* and 74*b* supply filtered oil to the valve lifters and piston cooler portions (not shown) of engine 2. Oil port 74*c* is the filtered oil supply, and port 74*d* routes oil from the supply pump outlet pocket 32 to the oil filter 34. Oil port 74*e* routes oil from oil reservoir 8 to the supply pump inlet pocket 33 through port 50, and port 74*f* routes oil from the cam chest and crankcase sumps 7 and 25 back to oil reservoir 8 through passage 49. Finally, oil port 74*g* is provided to adapt oil pump assembly 1 to be used with other engines, and is not operative in the illustrated example. A boss 77 is disposed in the lower portion of crankcase 3 adjacent rim 71, and has a hollow interior in which is received an O-ring seal 79, and which defines a return port 78 that communicates with the flywheel cavity or crankcase sump 25 to route oil to crankcase scavenge pump inlet 27, as described more fully hereinafter.

As best illustrated in FIG. 1, integrated cam drive and oil pump assembly 1 also includes a divider plate 85, which is assembled between first cam drive gear 15 and rear cam drive gear 16, as well as an idler gear shaft 86 for rotatably mounting idler gear 14, and a cam chest return gear shaft 87 for rotatably mounting cam chest return gear 18. Oil pump assembly 1 also includes a body cover plate 88 which is mounted over the right-hand or open side of oil pump body 9, and a cover 89 which is operably connected with crankcase 3 and encloses oil pump body 9 in the manner described more fully below.

Figure 8:
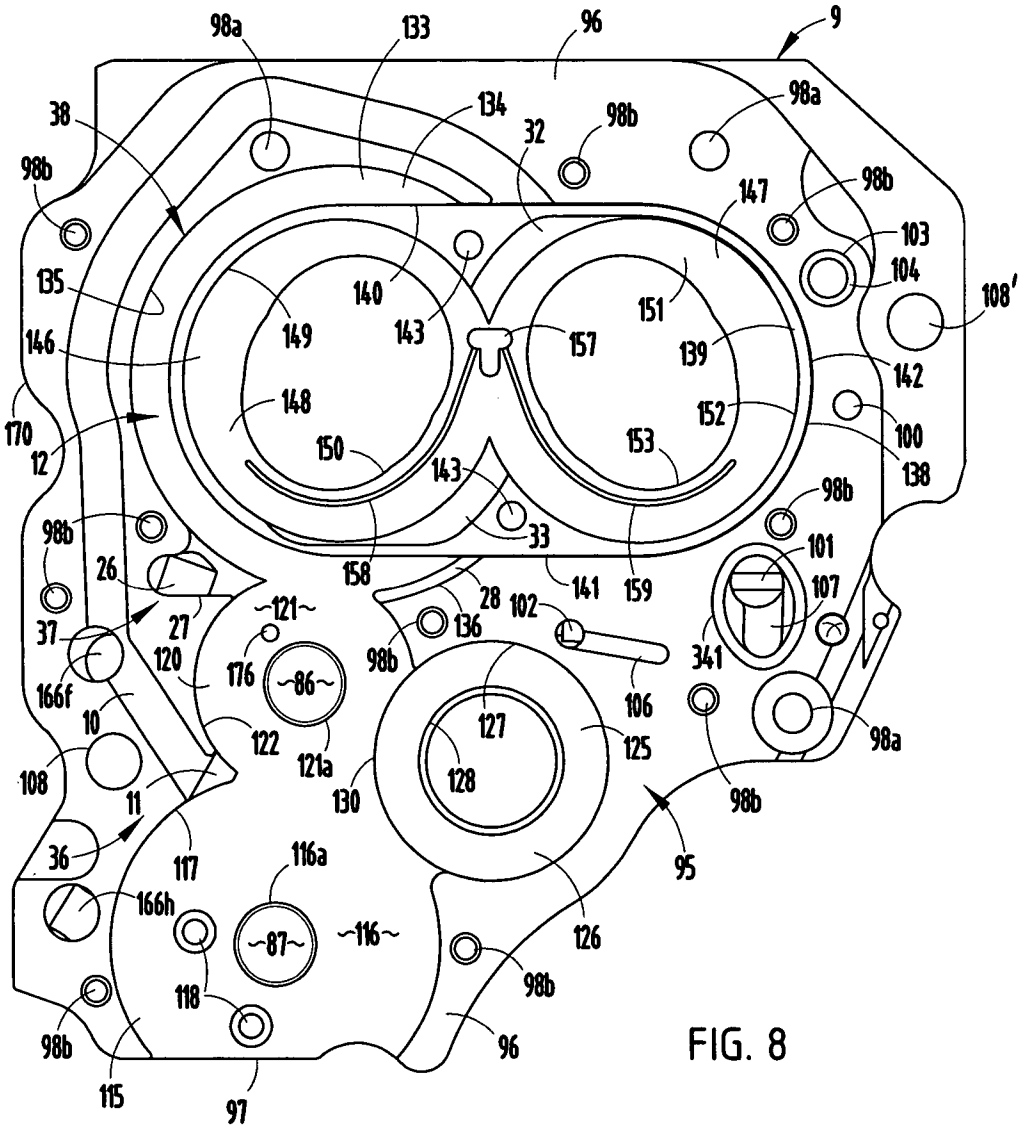
FIG. 8 is a front elevational view of an oil pump body portion of the assembly.
Figure 10:
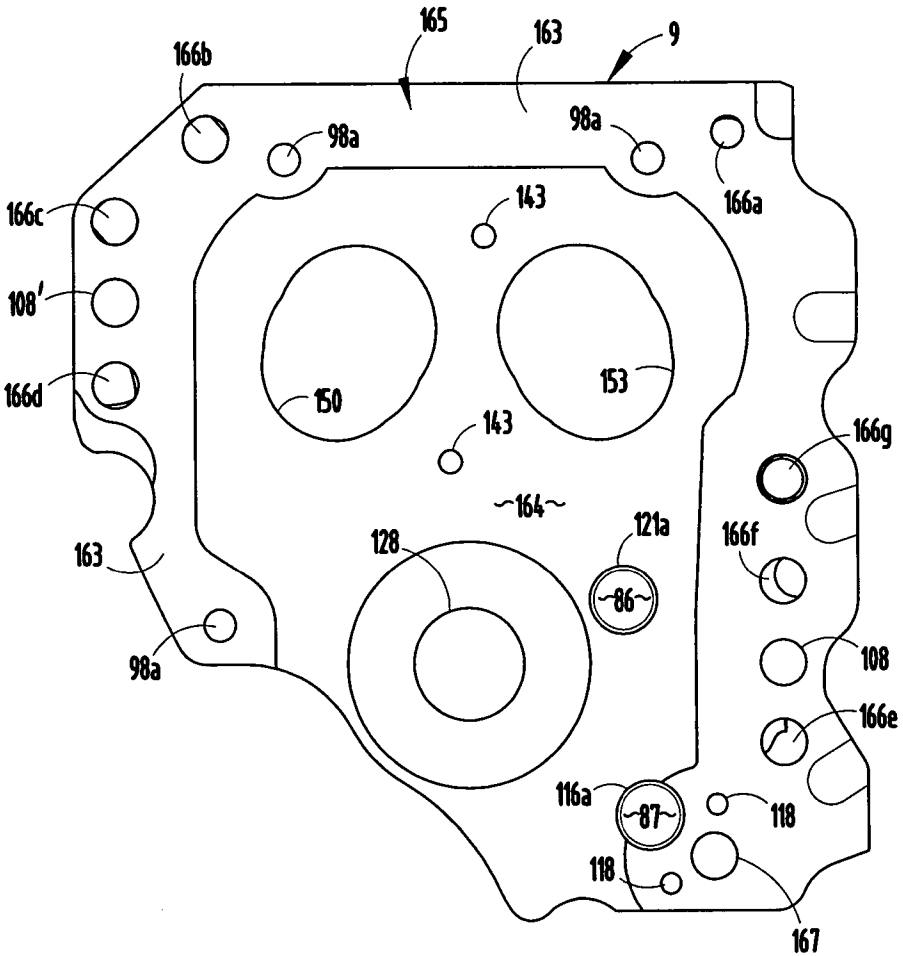
FIG. 10 is a rear elevational view of the oil pump body.
Figure 9:
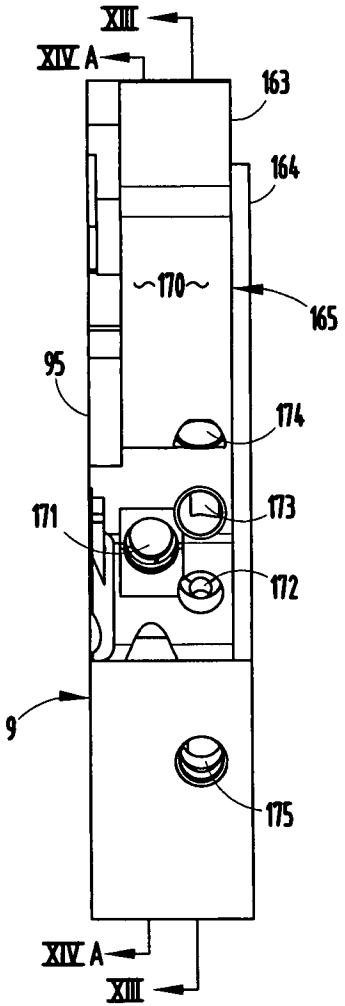
FIG. 9 is a side elevational view of the oil pump body.
Figure 34A:
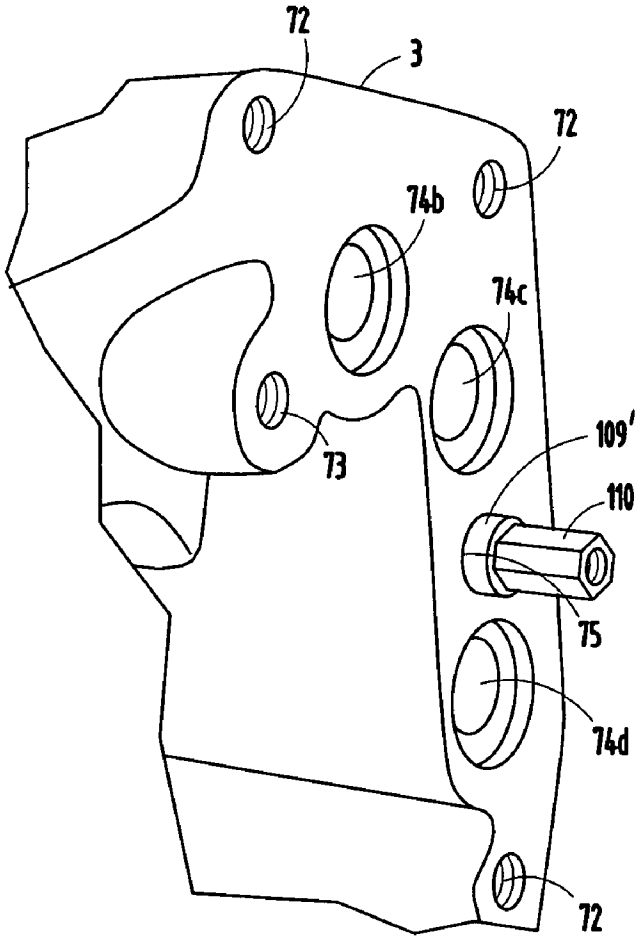
FIG. 34A is a fragmentary, perspective view of the crankcase, shown with an alignment dowel and thread adapter installed therein.

With reference to FIGS. 8–10, the illustrated oil pump body 9 has a machined billet construction, and functions as a housing for both the cam chest and oil pump assembly 1. Body 9 includes a right-hand exterior face 95 oriented away from crankcase 3, which has recessed portions configured to insert pinion gear 13, idler gear 14, cam drive gears 15–17, and cam chest return gear 18 into the interior 12 of oil pump body 9. The exterior face 95 of body 9 includes a rim 96 which extends around the margin of oil pump body 9, except at the bottom 97, which has an opening through which the lower portion of cam chest return gear 18 extends. Rim 96 includes three through fastener apertures 98*a*, which are aligned with threaded fastener apertures 73 in the outer face 70 of crankcase 3 to mount body 9 thereon, and ten threaded fastener apertures 98*b* to mount body cover plate 88 to body 9 in the manner described below. Rim 96 also includes ports 100, 101, 102, 166*h* and 166*f*, as well as slots 106 and 107. Ports 166*f* and 166*h* align with the ports 74*f* and 74*e* respectively in crankcase 3. Port 101 and slot 107 form part of pressure regulator 39, as described in detail below. Aperture 103 in the rim 96 of body 9 is configured to closely receive therein an associated hollow dowel pin 104 (FIG. 5). Rim 96 also includes a locating or alignment aperture 108 at the lower left-hand side of body 9 (as viewed in FIG. 8) in which a hollow locating or alignment dowel 109 (FIGS. 6 and 34A) is received and projects outwardly from body 9 to locate both cover plate 88 and cover 89 during assembly. A second alignment aperture 108' is spaced laterally apart from the alignment aperture 108 in rim 96, and is positioned at a recessed portion of the upper right-hand side of body 9 (as viewed in FIG. 8) to receive a hollow alignment dowel 109' therein to align body 9 with cover 89, as described in greater detail below.

Figure 4:
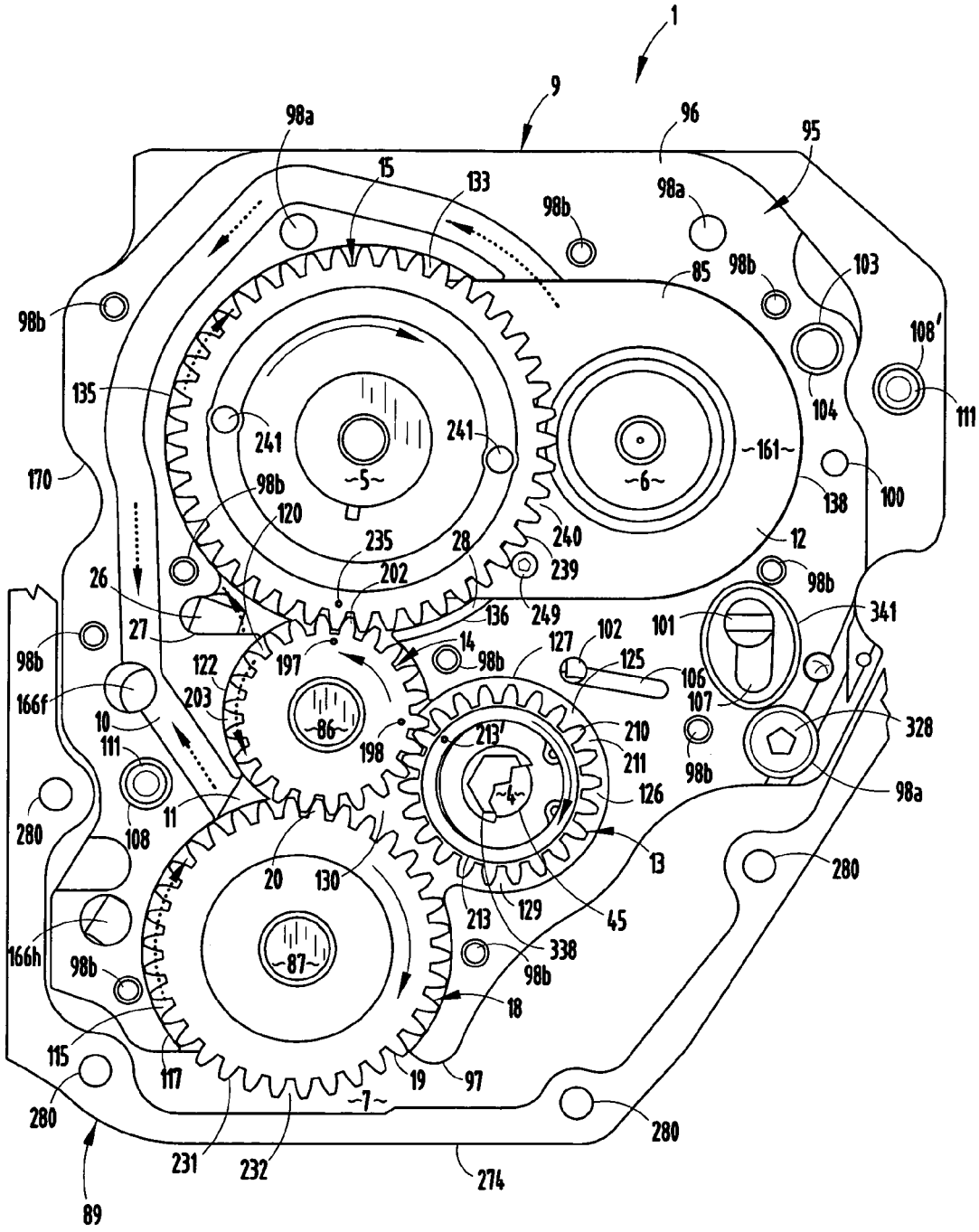
FIG. 4 is an enlarged, partially schematic view of a scavenge portion of the integrated cam drive and oil pump assembly.

As shown in FIGS. 8–10, the interior 12 of oil pump body 9 further includes a circular or cup-shaped cam chest return gear recess 115, which is defined by a base wall 116 and a sidewall 117, which opens to the exterior face 95 of oil pump body 9, and is sized to closely receive cam chest return gear 18 therein. The base wall 116 of cam chest return gear recess 115 includes a circular aperture 116*a* disposed concentric with sidewall 117, and configured to receive the left-hand end of cam chest return gear shaft 87 therein with a press fit. Sidewall 117 extends to the bottom 97 of rim 96, and terminates at that point, such that cam chest return gear 18 protrudes downwardly from the open bottom 97 of oil pump body 9 a predetermined distance into the cam chest sump 7 disposed immediately therebelow, as shown in FIGS. 4 and 5. That portion of cam chest return gear 18 which protrudes into cam chest sump 7 picks up oil in the cam chest sump and positively displaces the same between the teeth of cam chest return gear 18 and the sidewall 117 of cam chest return gear recess 115 to move oil directly from the cam chest sump, without requiring an inlet port or other similar restrictive opening. The base wall 116 of recess 115 also includes a pair of through fastener apertures 118 to mount an associated oil fitting 315 (FIGS. 1 and 34), as described below in greater detail.

The interior 12 of oil pump body 9 further includes a circular or cup-shaped idler gear recess 120 defined by a base wall 121, generally coextensive with base wall 116, and a sidewall 122 which opens to the exterior face 95 of oil pump body 9, and closely receives idler gear 14 therein. The base wall 121 of idler gear recess 120 includes a circular aperture 121*a* disposed concentric with sidewall 122, and configured to receive the left-hand end of idler gear shaft 86 therein with a press fit. The bottom portion of sidewall 122 intersects the upper portion of sidewall 117 at the inwardmost portions thereof, such that return gear cam chest recess 115 communicates with idler gear recess 120, and permits the teeth of the associated cam chest return gear 18 and idler gear 14 to mesh. In the example shown in FIG. 8, a generally triangularly-shaped land is formed at the intersection of sidewalls 117 and 122, and is slightly raised from base walls 116 and 121 to define pump outlet 11.

The interior 12 of oil pump body 9 also includes a circular or cup-shaped pinion gear recess 125, defined by a base wall 126, which is recessed somewhat relative to adjacent base walls 116 and 121, and a sidewall 127. Pinion gear recess 125 opens to the exterior face 95 of oil pump body 9, and is shaped to receive drive or pinion gear 13 therein. The base wall 126 of pinion gear recess 125 includes a circular aperture 128 to receive the outer end 45 of pinion shaft 4 therethrough. Sidewall 127 intersects an upper portion of the sidewall 117 of cam chest return gear recess 115 and a lower portion of sidewall 122 of idler gear recess 120, such that cam chest return gear recess 115, idler gear recess 120, and pinion gear recess 125 communicate, and permit the teeth of pinion gear 13 to mesh with the teeth of idler gear 14. As best illustrated in FIGS. 4 and 5, pinion gear recess 125 has a diameter larger than that of the associated pinion gear 13, so as to define a space or cavity 129 between sidewall 127 and the outermost portions of drive gear 13, which provides adequate clearance for pinion gear 13 even during flexure and/or vibrations in pinion shaft 4, and also assists in drawing oil from cam chest sump 7 in the manner described in greater detail hereinafter.

Figure 12:
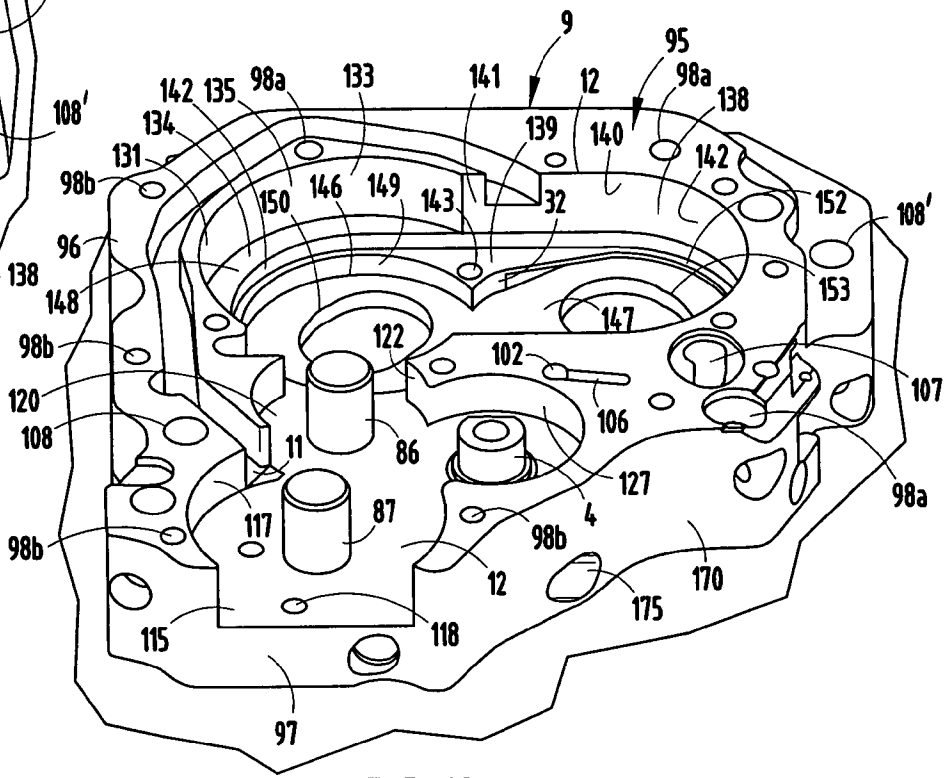
FIG. 12 is a perspective view of the oil pump body, taken from a lower portion thereof.
Figure 11:
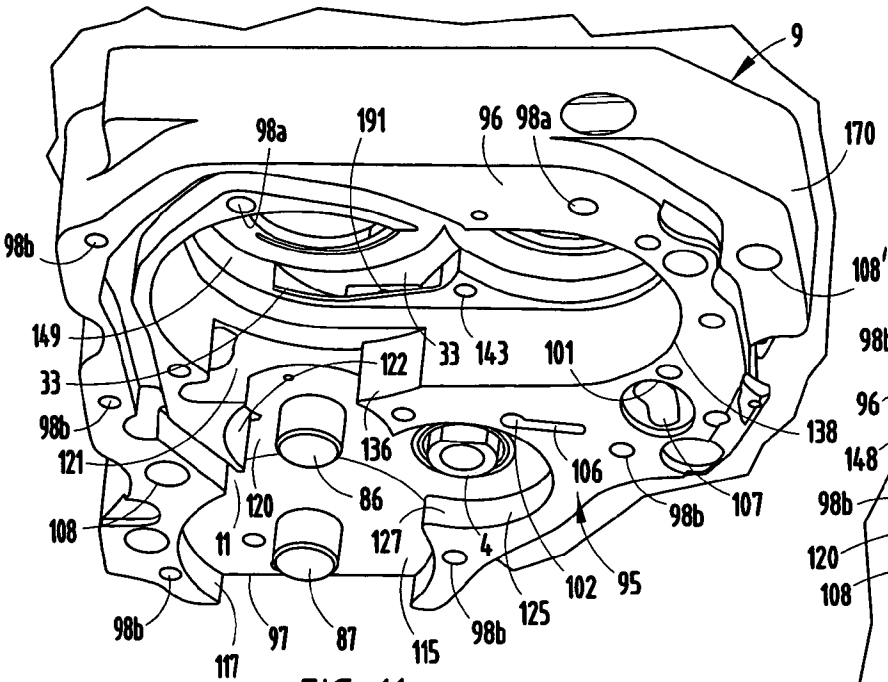
FIG. 11 is a perspective view of the oil pump body, taken from an upper portion thereof.

As best illustrated in FIGS. 11 and 12, the interior 12 of oil pump body 9 also includes an oval recess 138 defined by a relatively narrow base ledge 139, which is recessed relative to the base wall 121 of idler gear recess 120, and a sidewall 140 having straight upper and lower portions 141 and semicircular end portions 142. Two threaded fastener apertures 143 are disposed horizontally in base ledge 139 of oval recess 138, and are positioned adjacent the upper and lower portions 141 of sidewall 140 to mount divider plate 85 in the manner described below. Two circular or cup-shaped recesses 146 and 147 are disposed concentric with the semicircular end portions 142 of oval recess 138, are recessed into body 9 below base ledge 139, and are shaped to closely receive the second and third cam drive gears 16 and 17 therein. More specifically, recess 146, which is shaped to closely receive second cam drive gear 16 therein, is defined by a base wall 148 which is recessed relative to the base ledge 139 of oval recess 138, and a sidewall 149 which opens into oval recess 138. Base wall 148 includes an ovate aperture 150 (FIG. 8) therethrough to receive the rear camshaft 5 therethrough in the manner described in greater detail hereinafter. Recess 147 (FIGS. 11 and 12) is shaped to closely receive the third cam drive gear 17 therein, and is defined by a base wall 151 which is coextensive with base wall 148, and a sidewall 152 which intersects sidewall 149 to permit the teeth of second cam drive gear 16 and third cam drive gear 17 to mesh, and also opens to oval recess 138. Base wall 151 includes an oval aperture 153 (FIG. 8) through which the front camshaft 6 is received in the manner described in greater detail hereinafter. A T-shaped pressure control pocket 157 (FIG. 8) is formed in the base walls 148 and 151 of recesses 146 and 147 adjacent the medial, intersecting portions thereof, and serves to control oil flow in the manner described in greater detail hereinafter. A pair of arcuately-shaped channels 158 and 159 extend from pocket 157 around at least a portion of ovate apertures 150 and 153 to form an oil seal, as described below.

As best illustrated in FIGS. 11 and 12, pocket 33 defines the oil pump inlet for feed or supply pump 38, and is disposed along the lower portion of sidewall 149, as oriented in FIG. 11, adjacent the diverging side of intermeshed cam drive gears 16 and 17. Supply pump inlet pocket 33 is arcuate in shape, and extends along sidewall 149 from around a four o'clock position to a six o'clock position, and includes one end of pressure regulator passage 180 (FIG. 14), as discussed below. An outlet pocket 32 (FIG. 12), which is shaped similar to inlet pocket 33, is disposed along the upper portion of sidewall 152 at the converging side of intermeshed cam drive gears 16 and 17. Supply pump outlet pocket 32 is arcuate in shape, and extends along sidewall 152 from around a ten o'clock position to a twelve o'clock position. As described in greater detail hereinafter, supply pump inlet pocket 33 communicates with oil reservoir 8 to draw oil therefrom, and supply pump outlet pocket 32 communicates with filter 34 to flow supply oil through filter 34 to the engine 2 for lubrication of the various moving engine parts.

With reference to FIG. 12, the interior 12 of oil pump body 9 also includes a circular or cup-shaped first cam drive gear recess 133 defined by a base ledge 134 disposed generally coextensive with the outer or right-hand surface of divider plate 85, and a sidewall 135 which opens to the exterior face 95 of oil pump body 9. Sidewall 135 is concentric with the center of ovate aperture 150, and intersects with sidewall 122 at the upper portion of idler gear recess 120 in a manner which permits idler gear 14 to mesh with first cam drive gear 15. First cam drive gear recess 133 is sized to closely receive first cam drive gear 15 therein, except at arcuate relief 136 (FIG. 11), which is disposed along the lower, right-hand side of first cam drive gear 15 (as viewed in FIG. 4), adjacent the converging intermeshed teeth of idler gear 14 and first cam drive gear 15, and defines scavenge pump outlet 28, as described in greater detail below. As best illustrated in FIG. 4, when divider plate 85 is mounted in the base of oval recess 138, and first cam drive gear 15 is mounted on camshaft 5, a semi-annularly-shaped oil cavity 161 is formed between the right-hand side of cam drive gear 15 and the right-hand side of oval recess 138 (as viewed in FIG. 4) about the exterior surface of front camshaft 6. As explained below, oil cavity 161 communicates with oil passageway 10, and forms a portion of crankcase scavenge pump 37.

As shown in FIG. 8, the exterior face 95 of oil pump body 9 also includes a U-shaped channel which defines an upper portion of passageway 10, and extends in a generally arcuate fashion from oil cavity 161, around cam drive gear recess 133, and to scavenge oil return port 166*f*, and functions to route crankcase scavenge oil from crankcase scavenge pump 37 to oil reservoir 8. The lower portion of passageway 10 extends from the outlet 11 of cam scavenge pump 36 to scavenge oil return port 116*f*. In the illustrated example, passageway 10 is generally contiguous, and opens outwardly to the exterior face 95 of oil pump body 9, so as to form a hydraulic seal around portions of oil pumps 36, 37 and 38, in the manner described in greater detail below.

Figure 14:
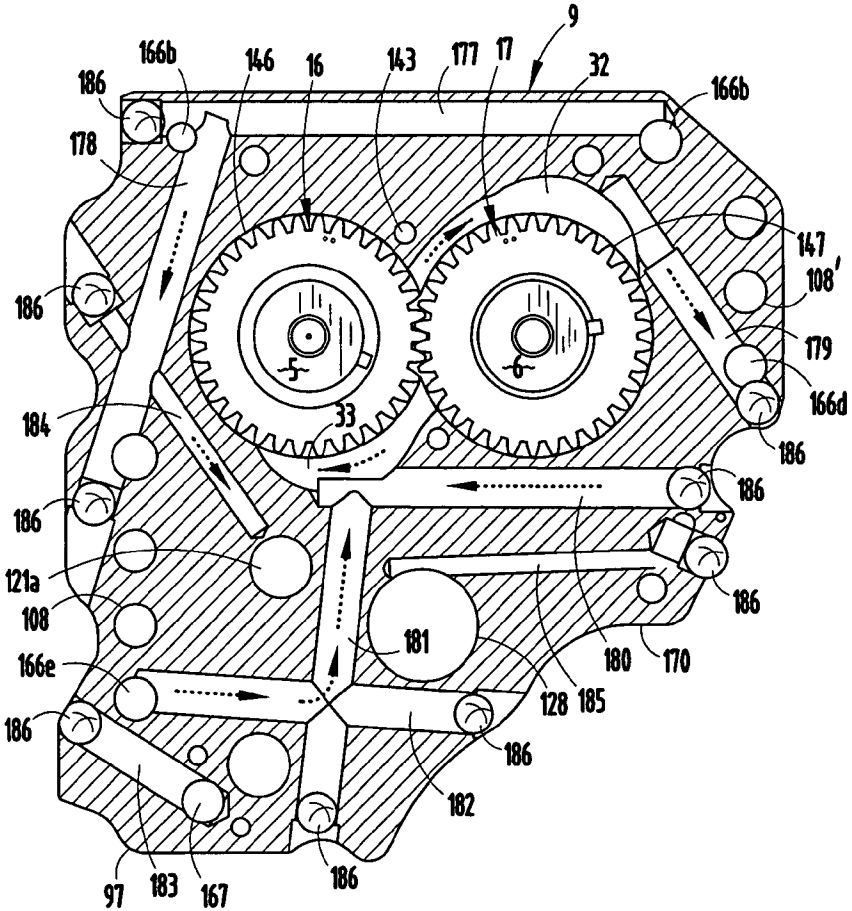
FIG. 14 is a vertical cross-sectional view of the oil pump assembly shown in FIG. 13, with supply gears mounted therein.
Figure 14B:
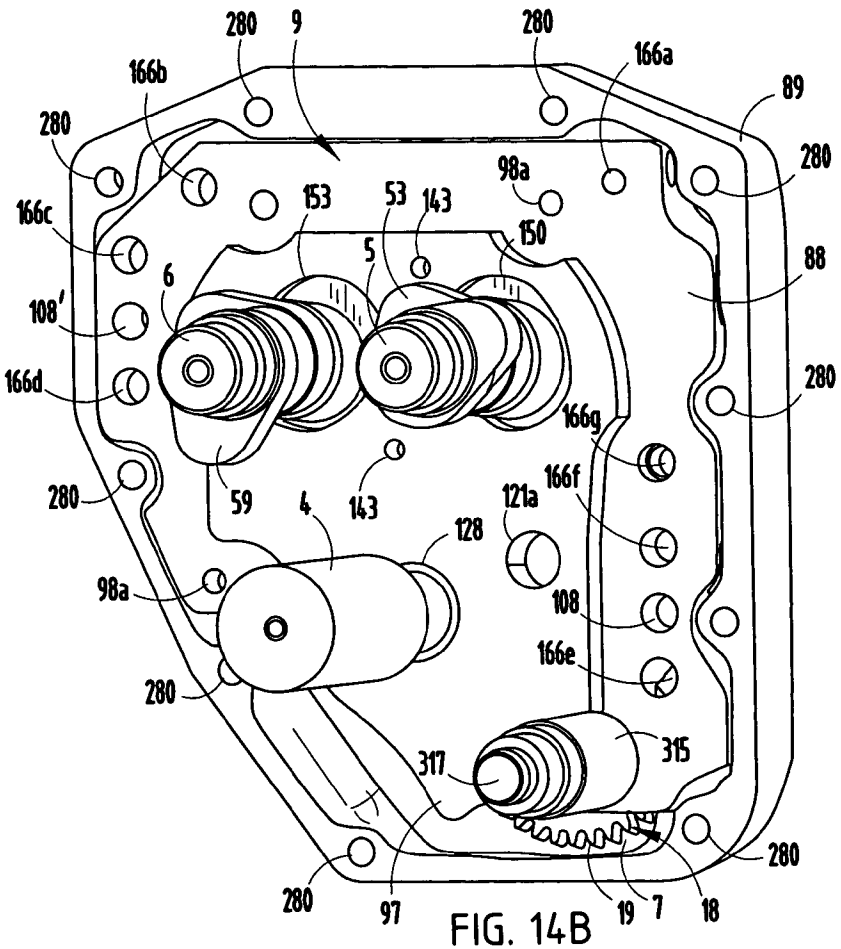
FIG. 14B is a rear perspective view of the integrated cam drive and oil pump assembly.

With reference to FIGS. 10 and 14B, the left-hand or interior face 165 of oil pump body 9 has a generally flat, marginal rim portion 163 adapted to mate with the rim 71 of crankcase 3, and a raised central portion 164, which protrudes slightly into the interior of crankcase 3. Through fastener apertures 98*a* extend through the interior face 165 of oil pump body 9, as do ovate apertures 150 and 153 to receive camshafts 5 and 6 therethrough, aperture 128 to receive pinion shaft 4 therethrough, apertures 116*a* and 121*a* which mount therein cam chest return gear shaft 87 and idler gear shaft 86, divider plate fastener apertures 143, and oil fitting mounting apertures 118. Alignment apertures 108 and 108' for locating dowels 109 and 109' also open through interior body face 165. The interior face 165 of body 9 also includes ports 166*a*, 166*b*, 166*c*, 166*d*, 166*f*, 166*g* and 166*e*, which align with ports 74*a*, 74*b*, 74*c*, 74*d*, 74*f*, 74*g* and 74*e* in the face 70 of crankcase 3, as well as return port 167, which communicates with crankcase sump 25.

With reference to FIG. 9, the outer sidewall 170 of oil pump body 9 is shaped to conform with the interior of cover 89, and includes a plurality of outwardly extending apertures and ports 171–175, which communicate with associated ones of ports 74*a*–74*e* to control the flow of oil through engine 2 and oil reservoir 8, and also control the pressure thereof in the manner described below.

Figure 13:
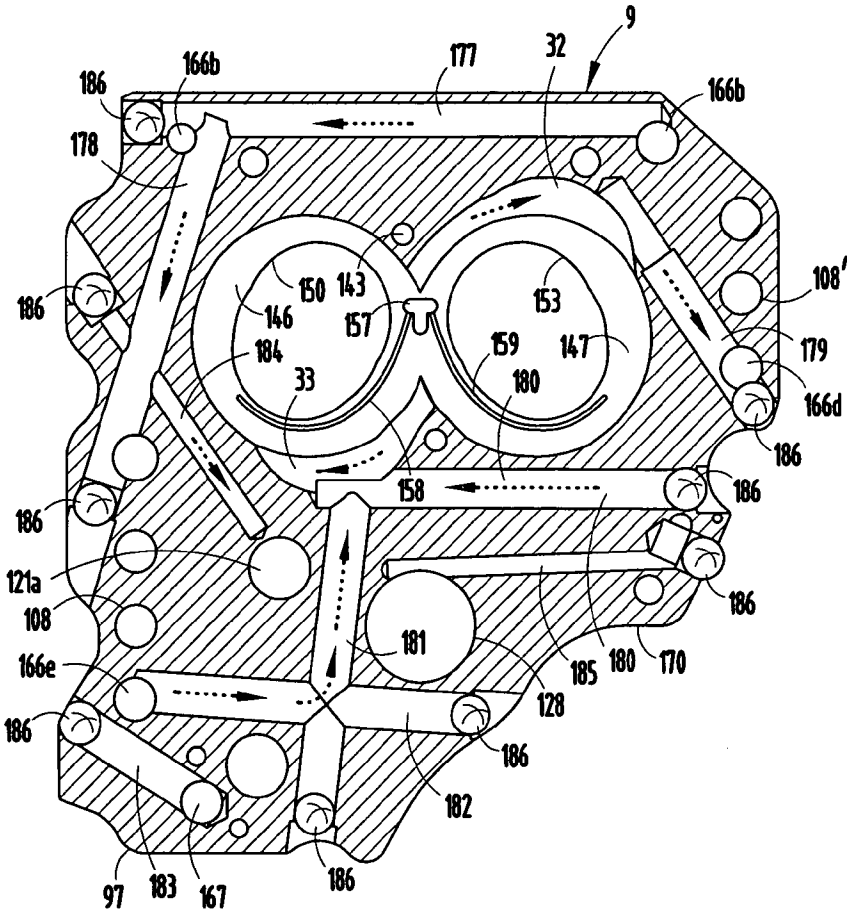
FIG. 13 is a vertical cross-sectional view of the oil pump body, taken along the line XIII—XIII, FIG. 9.

With reference to FIGS. 13 and 14, oil pump body 9 includes an upper internal passageway 177, which extends along exterior sidewall 170, and supplies filtered oil to the valve lifters and piston coolers (not shown) through ports 166*b* and an angled internal passageway 178, in the manner shown by the associated arrows in FIGS. 13 and 14. An angled internal passageway 179 extends from the right-hand portion of exterior sidewall 170 (as oriented in FIG. 13) to the outlet pocket 32 to supply oil to filter 34 through port 166*d*. A lateral internal passageway 180 extends from the right-hand side of oil pump body sidewall 170 (as oriented in FIG. 13) to inlet pocket 33 and communicates with pressure regulator 39. A generally vertical internal passageway 181 extends downwardly from the interior portion of lateral passageway 180 to pump inlet pocket 33, and communicates with oil reservoir 8 through a crossing passageway 182 which extends from port 166*e*, and intersects vertical passageway 181. An inclined internal passageway 183 extends from the left-hand side of oil pump body sidewall 170 (as oriented in FIG. 13) downwardly to port 167, which communicates with the passageway from crankcase sump or flywheel cavity 25. In the example shown in FIGS. 13 and 14, a second inclined internal passageway 184 extends from an upper left-hand portion of body sidewall 170 (as oriented in FIG. 13) downwardly to aperture 121*a* and idler gear shaft 86 to supply filtered oil to the bushing associated with idler gear 14. Oil passageway 184 communicates with a port 176 in the base wall 121 of idler gear recess 120 to supply oil to idler gear 14. A second lateral passageway 185 extends from the right-hand side of body sidewall 170 (as oriented in FIG. 13) laterally inwardly to aperture 128 and the support bushing for pinion shaft 4 to supply filtered oil thereto. Solid spherical balls or plugs 186 are pressed into the open ends of internal passageways 177–185 to achieve the desired oil flow.

Figure 14A:
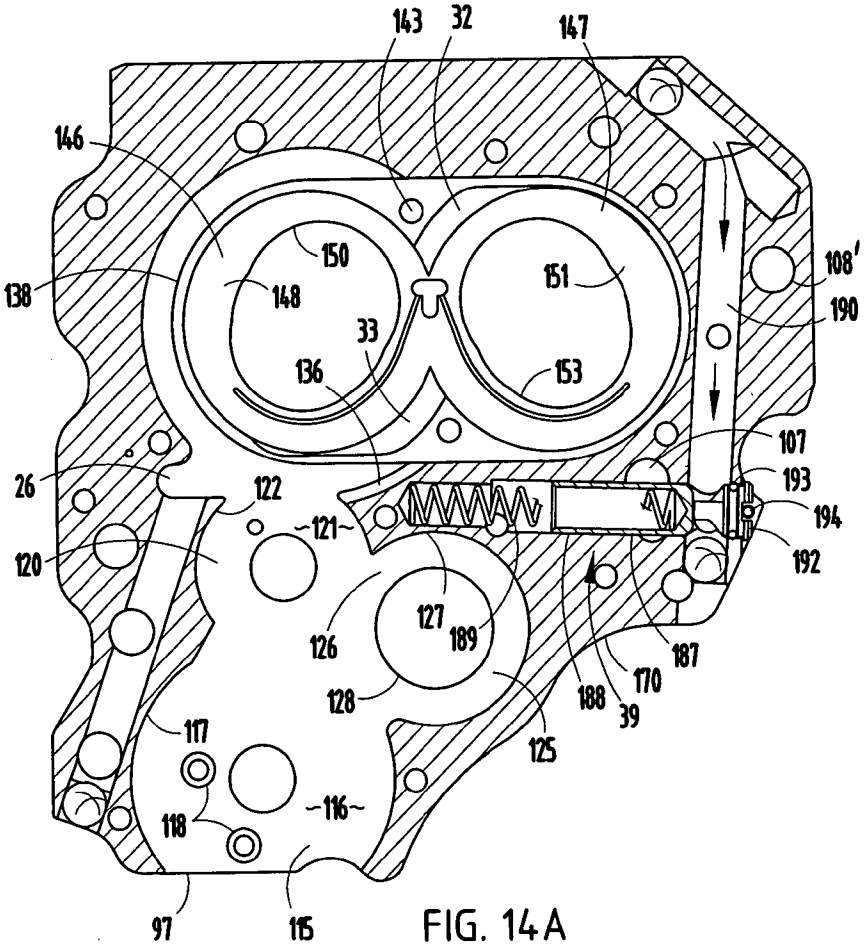
FIG. 14A is another vertical cross-sectional view of the oil pump body, taken along the line XIVA—XIVA, FIG. 9.

With reference to FIGS. 1 and 14A, the illustrated oil pressure regulator or controller 39 is in the form of a reciprocating plunger 187, which shifts laterally in an associated plunger passageway 188 under the influence of coil spring 189 to route oil back to the supply pump inlet 33 when oil pressure exceeds a predetermined amount. As best illustrated in FIG. 14A, filtered supply oil flows through internal passageway 190 in body 9 to plunger passageway 188 in which plunger 187 is slidably mounted. The outer end of plunger 187 is cone-shaped, and shifts laterally in plunger passageway 188 to close and open a pressure regulating valve slot 107, which is oriented generally perpendicularly to plunger passageway 188, and communicates with the supply pump inlet pocket 33. Coil spring 189 resiliently urges plunger 187 outwardly, which normally closes off pressure relief valve slot 107. As engine supply oil pressure increases, as reflected in passageway 190, plunger 187 shifts to the left (as viewed in FIG. 14A), overcoming the extending resilient force of coil spring 189. When the engine oil supply pressure, as reflected in passageway 190, reaches a predetermined amount, plunger 187 will shift slightly past pressure relief valve slot 107, and route oil back to the supply pump inlet 33, thereby maintaining supply oil pressure to the lubricated parts of engine 2 at a preselected level. Should supply oil pressure continue to increase, plunger 187 is shifted further to the left (as viewed in FIG. 14*a*), thereby enlarging the opening to pressure relief valve slot 107, thereby maintaining proper engine supply oil pressure. As best illustrated in FIG. 3, oil pressure regulator 39 is located downstream of oil filter 34, such that oil pressure variations across filter 34, such as experienced with a cold start, a clogged filter, etc., will not affect the engine supply oil pressure. In the illustrated example, a plug 192 and mating O-ring seal 193 close off the open end of plunger passageway 188. Plug 192 also functions as a stop to limit the travel of plungers 187. A dowel pin 194 positively retains plug 192 in place in body 9. An O-ring 341 is mounted in a mating recess about pressure relief passage 101 and slot 107 on the outer face of body 9 to form a seal with body cover plate 88.

Figures 15, 16, 17, 18, 19, 20, 21, 22:
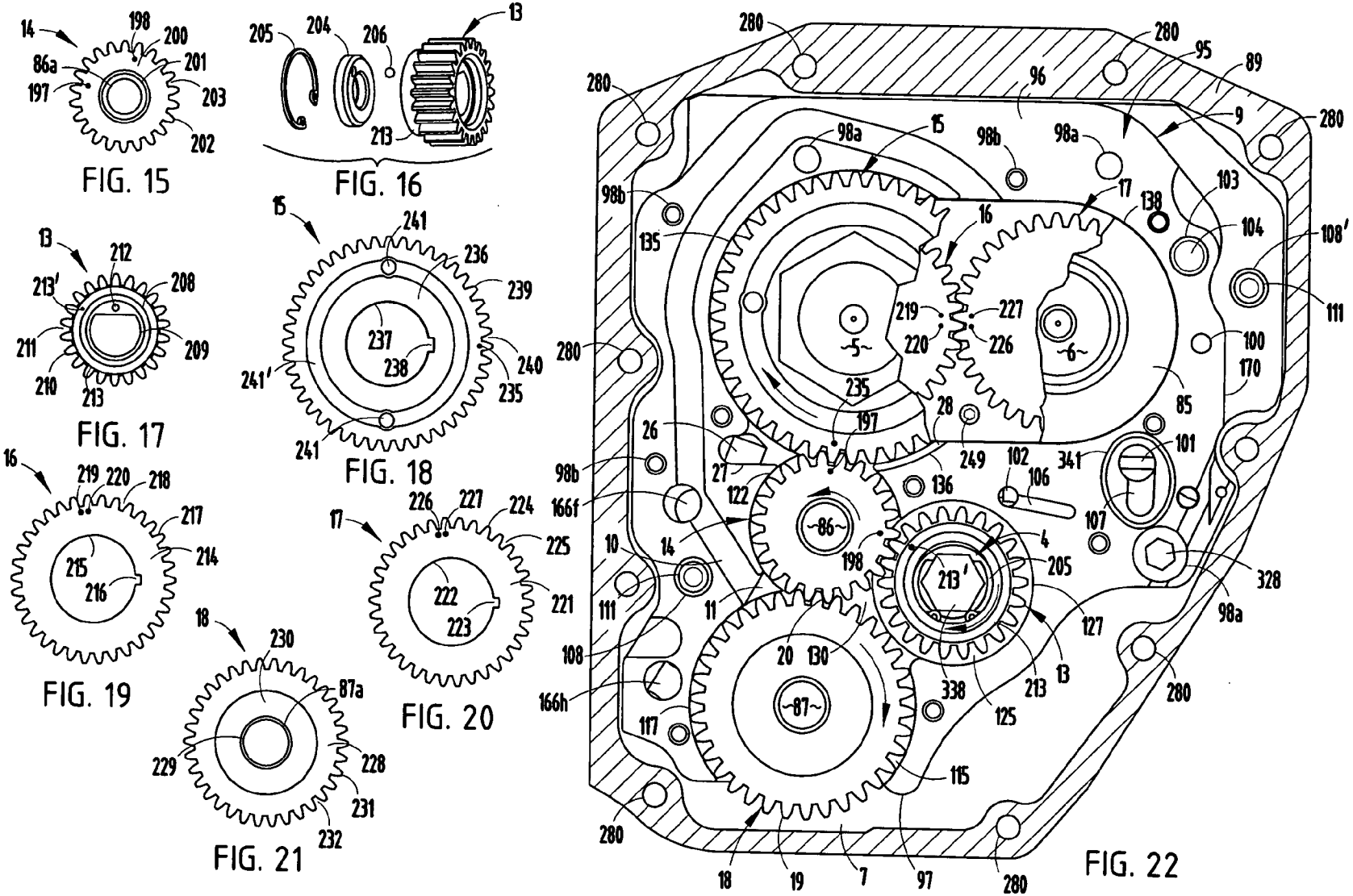
FIG. 15 is a front elevational view of an idler gear portion of the assembly.
FIG. 16 is an exploded perspective view of a pinion gear and related mounting hardware portions of the assembly.
FIG. 17 is a front elevational view of the pinion gear by itself, without the associated mounting hardware.
FIG. 18 is a front elevational view of a first cam drive gear portion of the assembly.
FIG. 19 is a front elevational view of a rear cam drive gear portion of the assembly.
FIG. 20 is a front elevational view of a front cam drive gear portion of the assembly.
FIG. 21 is a front elevational view of a cam chest return gear portion of the assembly.
FIG. 22 is a front elevational view of the oil pump body with the pinion gear, idler gear, cam drive gears, and cam chest return gear installed therein, with portions thereof broken away to reveal internal construction.

With reference to FIGS. 15–21, drive gear 13, idler gear 14, and cam drive gears 15–17 are each spur-type gears, which are designed to intermesh in the manner illustrated in FIG. 22. More specifically, as best illustrated in FIGS. 15 and 22, idler gear 14 comprises a hub 200 having a circular central aperture 201 therethrough in which idler gear bushing 86*a* and associated mounting shaft 86 (FIG. 22) are received. Idler gear 14 (FIG. 15) includes a plurality of teeth 202 extending radially from hub 200, which define spaces 203 therebetween. The illustrated idler gear 14 has a diameter that is smaller than cam drive gears 15–17 and cam chest return gear 18. The rear face of idler gear 14 may be provided with a counter bore (not shown) to interface with oil port 176. The front face of the illustrated idler gear 14 includes two timing marks 197 and 198 to facilitate synchronization with pinion gear 13 and cam drive gear 15.

In the example illustrated in FIGS. 16, 17 and 22, drive or pinion gear 13 has approximately the same diameter as idler gear 14, and includes a hub 208 with a central noncircular aperture 209 therethrough for mounting pinion gear 13 to the outer end 45 of pinion shaft 4 for rotation therewith. Pinion gear 13 includes teeth 210 extending radially from hub 208, which define spaces 211 therebetween. The hub 208 of illustrated pinion gear 13 includes a recess 212 in which a retainer ball 206 is received to mount pinion gear 13 on pinion shaft 4 using a mating apertured washer 204 and retainer ring 205, as described in greater detail below. The exterior face of pinion gear 13 includes an outwardly projecting, annularly-shaped ring 213 disposed concentric with aperture 209, and bearing a timing mark 213' to synchronize with idler gear 14. Preferably, the inside diameter of washer 204 is threaded to facilitate pulling pinion gear 13 off of pinion shaft 4 using an associated tool (not shown).

The second and third cam drive gears 16 and 17 (FIGS. 19, 20) are substantially identical in construction, and in the illustrated example, are larger in diameter than pinion gear 13 and idler gear 14. With reference to FIG. 19, the second cam drive gear 16 includes a hub 214 with a circular central aperture 215 in which the left-hand end of rear camshaft 5 is closely received. Hub 214 includes a keyway 216 in which a key (not shown) is received for positively mounting second cam drive gear 16 to rear camshaft 5, such that the same rotate together, and insure proper synchronization. Second cam drive gear 16 includes a plurality of radially extending teeth 217, which define spaces 218 therebetween. Cam drive gear 16 also has two timing marks 219 and 220 on the outer face thereof to insure proper synchronization with cam drive gear 17. In the illustrated example, timing mark 219 comprises a dimple located in radial alignment with the root of adjacent teeth 217, while timing mark 220 comprises a dimple located in radial alignment with the tip of the next adjacent tooth 217. In this manner, gears 16 and 17 can be used interchangeably on either rear camshaft 5 or front camshaft 6.

With reference to FIG. 20, the third cam drive gear 17 also includes a hub 221 having a circular central aperture 222 extending therethrough in which the left-hand end of front camshaft 6 is closely received. Hub 221 also includes a keyway 223 in which a key (not shown) is received to positively mount third cam drive gear 17 to front camshaft 6, such that the same rotate together, and insure proper synchronization. Third cam drive gear 17 includes radially extending teeth 224, which define spaces 225 therebetween, as well as timing marks 226 and 227, which align with the timing marks 219 and 220 on cam drive gear 16.

With reference to FIG. 21, the illustrated cam chest return gear 18 has a diameter somewhat larger than the diameter of previously described cam drive gears 16 and 17, and includes a hub 228 with a circular central aperture 229 therethrough in which cam return gear bushing 87*a* and associated shaft 87 are closely received to rotatably mount cam chest return gear 18 in oil pump body 9. Cam chest return gear 18 includes a circular counter bore 230, which feeds oil to the associated bushing 87*a* and reduces drag, as well as a plurality of radially extending teeth 231, which define spaces 232 therebetween.

With reference to FIG. 18, the illustrated first cam drive gear 15 has a diameter somewhat larger than that of previously described cam chest return gear 18, and includes a hub 236 having a circular central aperture 237 in which the right-hand end of rear camshaft 5 is closely received. Hub 236 includes a keyway 238 in which a key (not shown) is received to positively retain first cam drive gear 15 on rear camshaft 5 for rotation therewith. First cam drive gear 15 includes a plurality of radially extending teeth 239, which define spaces 240 therebetween. A pair of threaded apertures 241 extend through the opposite faces of cam drive gear 15 to facilitate pulling gear 15 from the rear camshaft 5, and also to provide lubrication in conjunction with grooves 241'. A timing mark 235 is provided on the outer face of cam drive gear 15 to insure proper synchronization.

Figure 24:
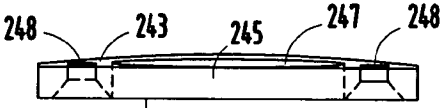
FIG. 24 is an end elevational view of a divider plate portion of the integrated cam drive and oil pump assembly.
Figure 25A:
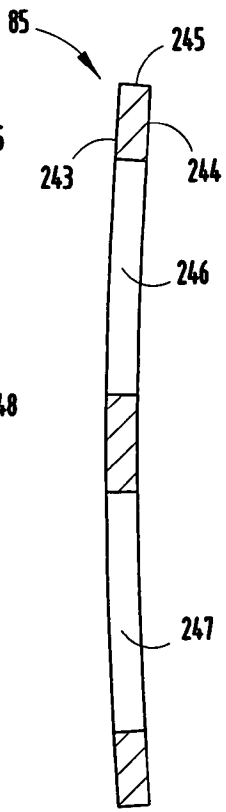
FIG. 25A is a cross-sectional view of the divider plate, taken along the line XXVA—XXVA, FIG. 25.
Figure 25:
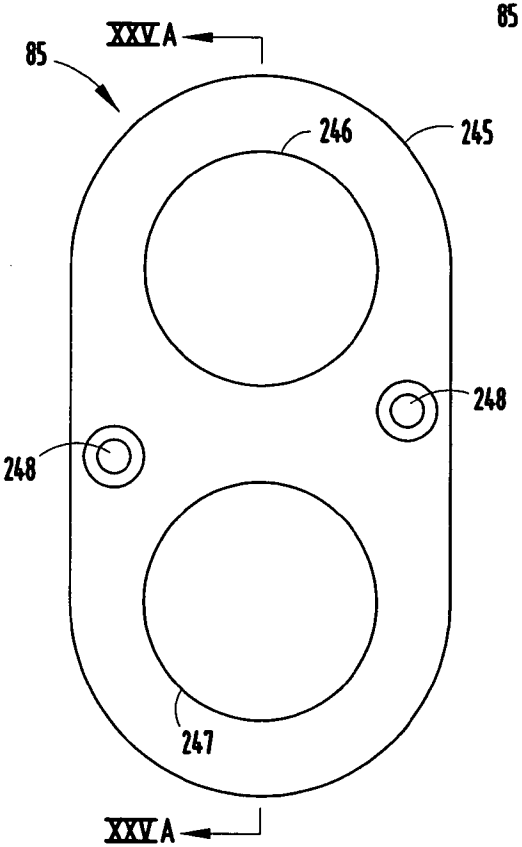
FIG. 25 is a front elevational view of the divider plate.
Figure 23:
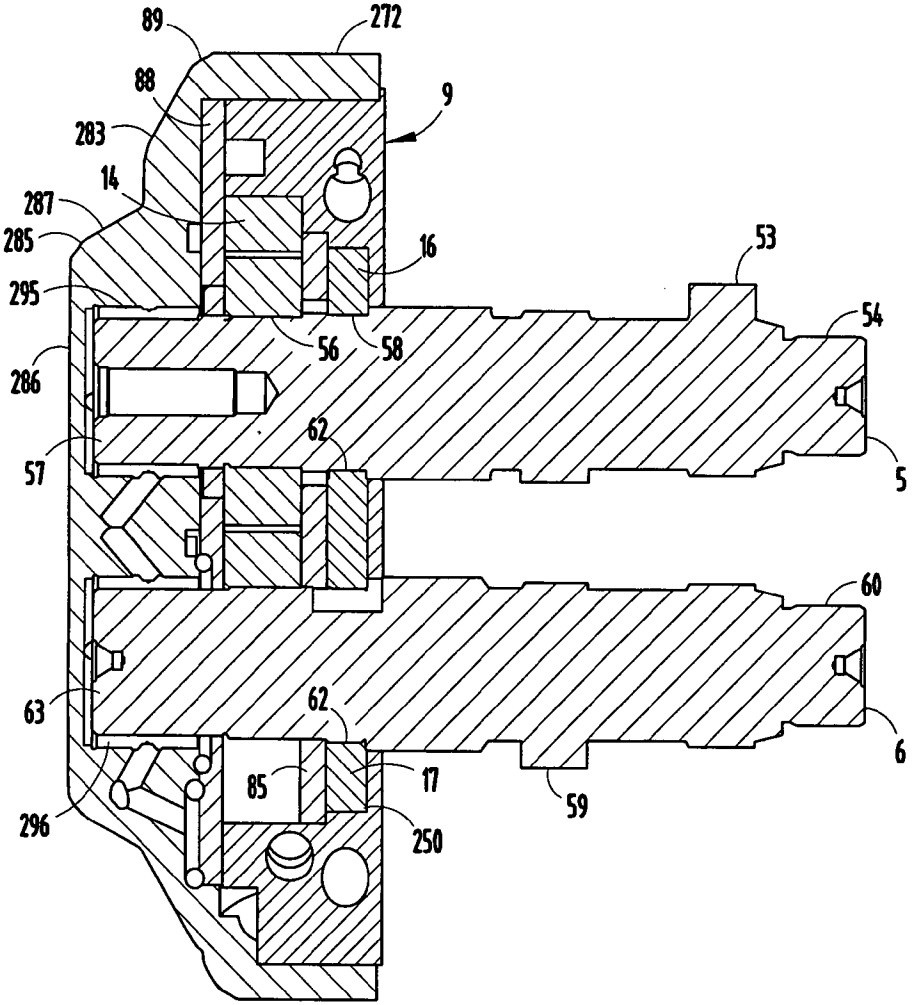
FIG. 23 is a horizontal cross-sectional view of the integrated cam drive and oil pump assembly, shown with the camshafts installed therein.
Figure 28:
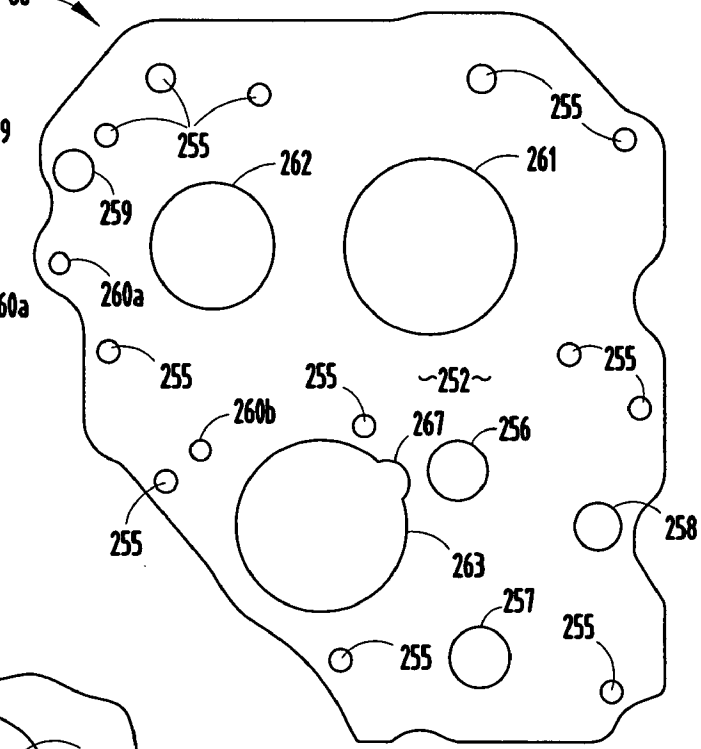
FIG. 28 is a rear elevational view of the body cover plate.
Figure 29:
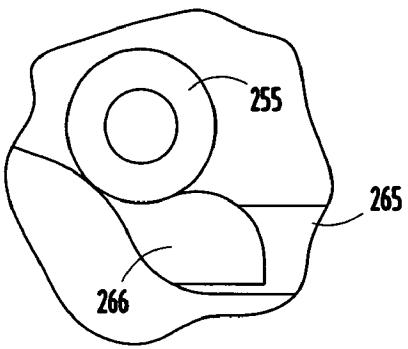
FIG. 29 is an enlarged elevational view of that portion of the body cover plate within the circle identified as XXIX, FIG. 27.

With reference to FIGS. 23–25, the illustrated divider plate 85 has an oval shape, which is sized to be closely received within the oval recess 138 of oil pump body 9. More specifically, divider plate 85 includes a pair of arcuate, parallel side faces 243 and 244 and an oval side edge 245 configured to abut and seal closely against the shoulder which defines the oval recess 138 of oil pump body 9. The illustrated divider plate 85 includes a pair of circular apertures 246 and 247 disposed adjacent opposite ends of divider plate 85, which are arranged in a laterally aligned relationship. Aperture 246 is shaped to receive rear camshaft 5 therethrough, while aperture 247 is shaped to receive front camshaft 6 therethrough. The illustrated divider plate 85 also includes a pair of fastener apertures 248, which are aligned with threaded fastener 143 in body 9, and through which associated fasteners 249 extend to attach divider plate 85 to body 9 in the manner shown in FIGS. 23 and 35. Divider plate 85 is disposed axially between the intermeshed second and third cam drive gears 16 and 17 and the first cam drive gear 15. Hence, divider plate 85, along with body 9, define a cavity 250 (FIG. 23) in which cam drive gears 16 and 17 are disposed, which isolates the supply pump outlet and inlet pockets 32 and 33 from the scavenge side of oil pump assembly 1, as described in greater detail hereinafter. Divider plate 85 is able to isolate cavity 250 without the benefit of a separate gasket due to the tight fit between the divider plate 85 and recess 138 along their abutting interfaces. More specifically, the curved side faces 243 and 244 of the illustrated divider plate 85 create a preload as the divider plate is drawn by fasteners 249 against the flat shoulder around recess 138, which resists the force applied to the interior side of divider plate 85 when oil pressure rises in cavity 250. Also, the arcuate channels 158 and 159 in body 9 form hydraulic seals about ovate apertures 150 and 153, which serve to isolate or seal cavity 250.

Figure 27:
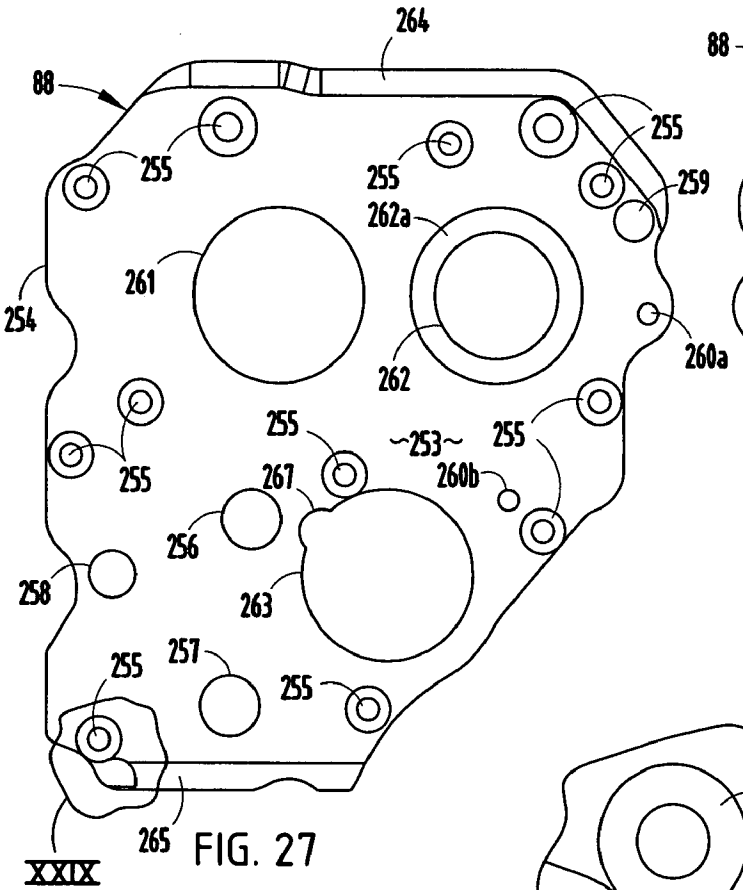
FIG. 27 is a front elevational view of the body cover plate.
Figure 26:
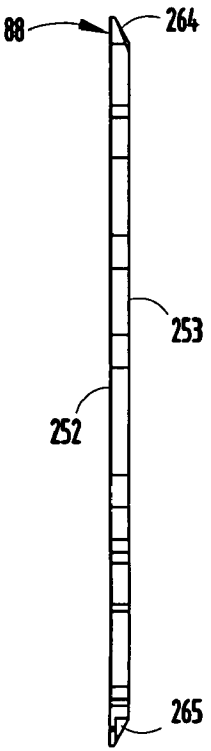
FIG. 26 is a side elevational view of a body cover plate portion of the integrated cam drive and oil pump assembly.

With reference to FIGS. 26–29, the illustrated cover plate 88 is shaped to enclose a major portion of the exterior face 95 of oil pump body 9. Cover plate 88 has substantially flat opposing side faces 252 and 253, and a marginal edge 254, which is shaped substantially similar to the exterior sidewall 170 of oil pump body 9. Cover plate 88 includes twelve fastener apertures 255 arranged in a spaced apart pattern substantially identical to that of the fastener apertures 98*a* and 98*b* in body 9, as well as aperture 256 to receive the outer end of idler gear shaft 86 therein, aperture 257 to receive the outer end of cam chest return gear shaft 87 therein, aperture 258 to receive the outer end of the rearward one of dowel 111 therethrough, aperture 259 to receive the outer end of dowel 104 therethrough, oil port 260*a* positioned to supply lubricating oil to the bushings 295 and 296 in cover 89, and oil drain port 260*b* which communicates with pressure regulator 39. Furthermore, cover plate 88 includes a circular through aperture 261, which is axially aligned with the central axis of ovate aperture 150 in oil pump body 9, and is adapted to receive therethrough the right-hand end of rear camshaft 5 and associated nut 334. Cover plate 88 also includes a second circular aperture 262, which is disposed generally concentric with the central axis of the ovate aperture 153 in body 9, and is configured to receive the right-hand end of front camshaft 6 therethrough. A circular counter bore 262*a* extends around aperture 262, and is configured to receive and retain an O-ring seal 342 therein, as described below. Cover plate 88 also includes a third circular aperture 263, which is axially aligned with the central axis of the end portion 45 of pinion shaft 4, and receives the same therethrough. As best illustrated in FIGS. 26 and 27, the upper and lower edges 264 and 265 of cover plate 88 are beveled or angled. Furthermore, the lower edge 265 of cover plate 88 includes a relief 266 (FIG. 29) disposed adjacent fastener aperture 255, which mates with an associated portion of cover 89 to provide clearance for adjacent parts of the motorcycle. The illustrated cover plate 88 also includes a timing notch 267, which extends outwardly from the perimeter of third circular aperture 263 to align with the timing mark 213' on pinion gear 13.

Figure 31:
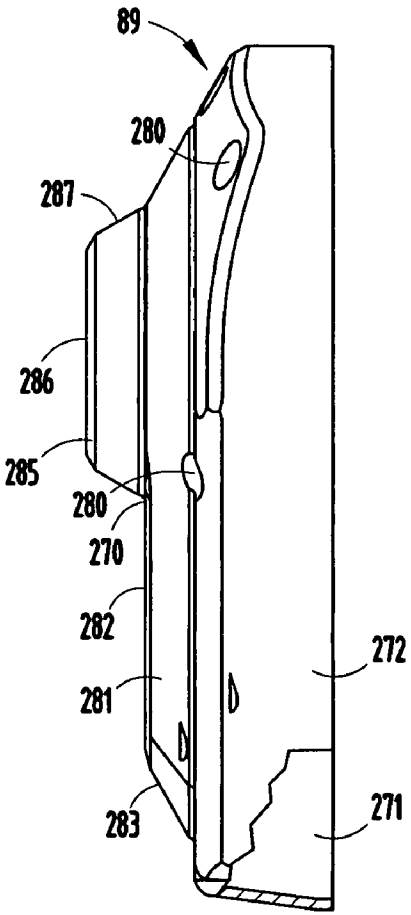
FIG. 31 is a side elevational view of the cover, with a portion thereof broken away.
Figure 30:
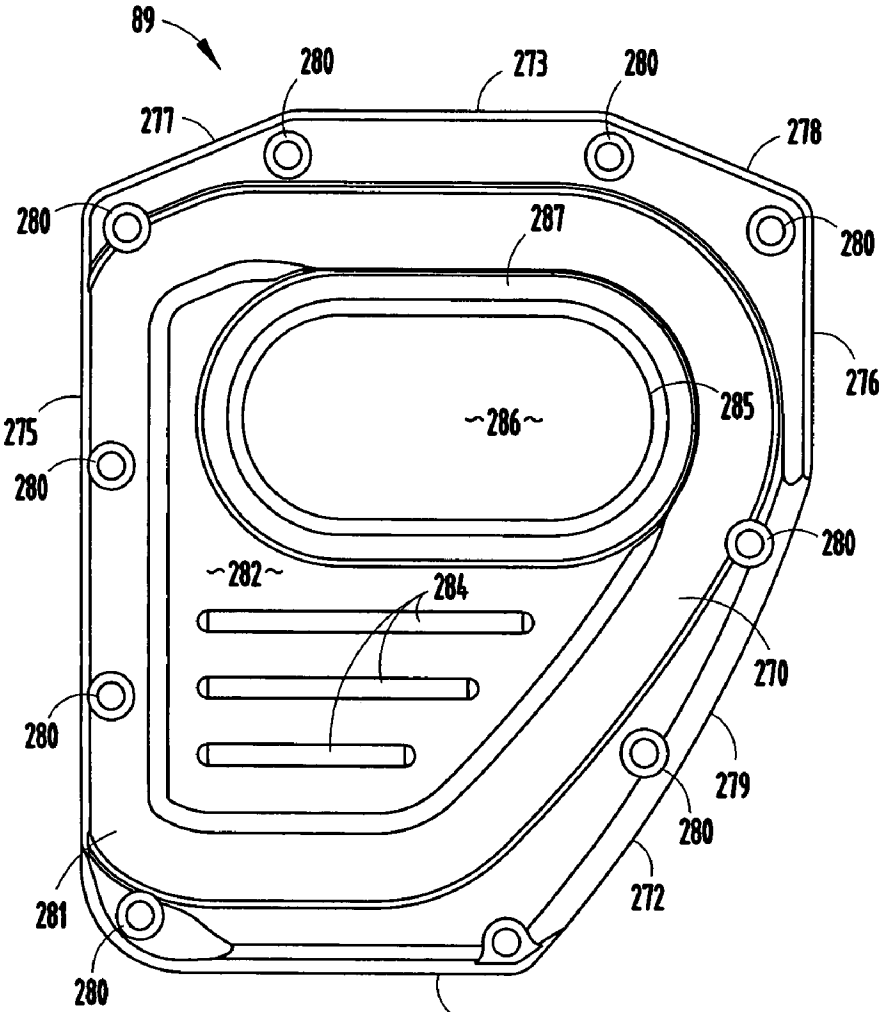
FIG. 30 is a front elevational view of the cover.
Figure 33:
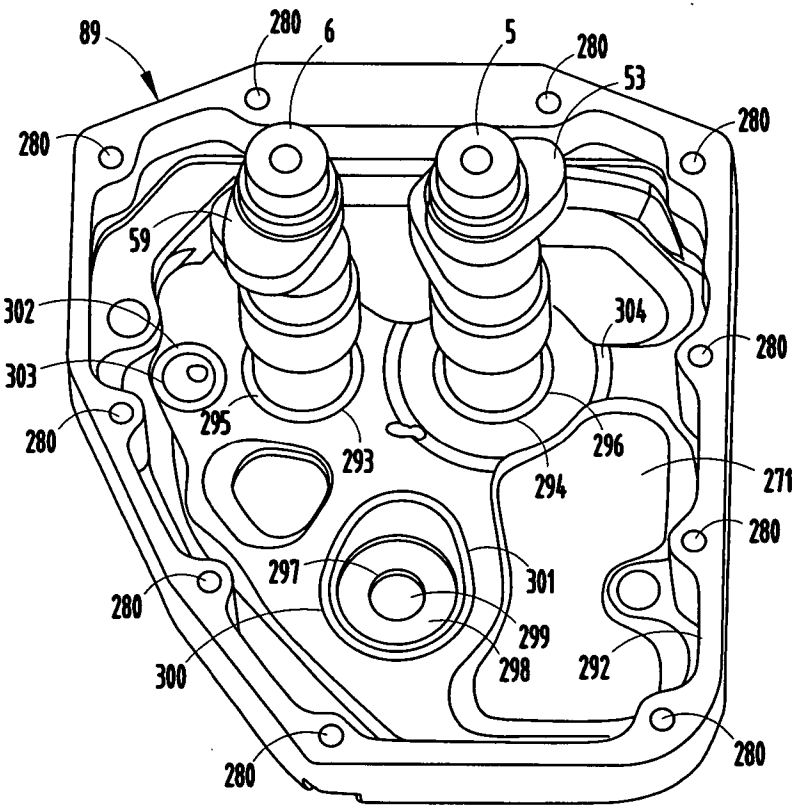
FIG. 33 is a perspective view of the interior side of the cover, with the camshafts installed therein.

With reference to FIGS. 30–33, the illustrated cover 89 has a machined billet construction, and is attached to the rim 71 on the exterior face 70 of crankcase 3. Cover 89 is configured to enclose oil pump assembly 1, and also serves to enclose and support the outer ends of camshafts 5 and 6 as well. More specifically, cover 89 is generally cup-shaped, and includes a contoured exterior surface 270 and a recessed interior surface 271. Cover 89 includes an outwardly protruding sidewall 272 which extends along the marginal edge of cam chest cover 89, and is shaped substantially similar to the exterior face 70 of crankcase 3. With reference to FIGS. 30 and 31, sidewall 272 includes generally straight, mutually parallel upper and lower portions 273 and 274, opposed, generally straight side portions 275 and 276 which are oriented generally perpendicularly with upper and lower portions 273 and 274, as well as angled upper corner portions 277 and 278 which extend from upper portion 273 to side portions 275 and 276 respectively, and an arcuate lower front portion 279 which extends from side portion 276 to lower portion 274. Ten fastener apertures 280 extend horizontally through the exterior surface 270 of cover 89 along sidewall portions 273–279, and are arranged in a pattern substantially identical with fastener apertures 72 in the exterior face 70 of crankcase 3. The exterior surface 270 of cover 89 includes an outwardly protruding rim portion 281 which includes a generally flat right surface 282 and a beveled marginal edge 283 which is shaped similar to the shape of sidewall 272, and is spaced inwardly thereof. The right surface 282 of rim portion 281 includes three decorative arcuate channels 284 of varying lengths extending along the lower portion thereof in a mutually parallel, vertically spaced apart relationship. The exterior surface 270 of cover 89 also includes an oval nose portion 285 which protrudes outwardly from rim portion 281, and is defined by a generally flat right surface 286 and a tapered sidewall 287, having an oval shape similar to that of the oval recess 138 in body 9.

Figure 32:
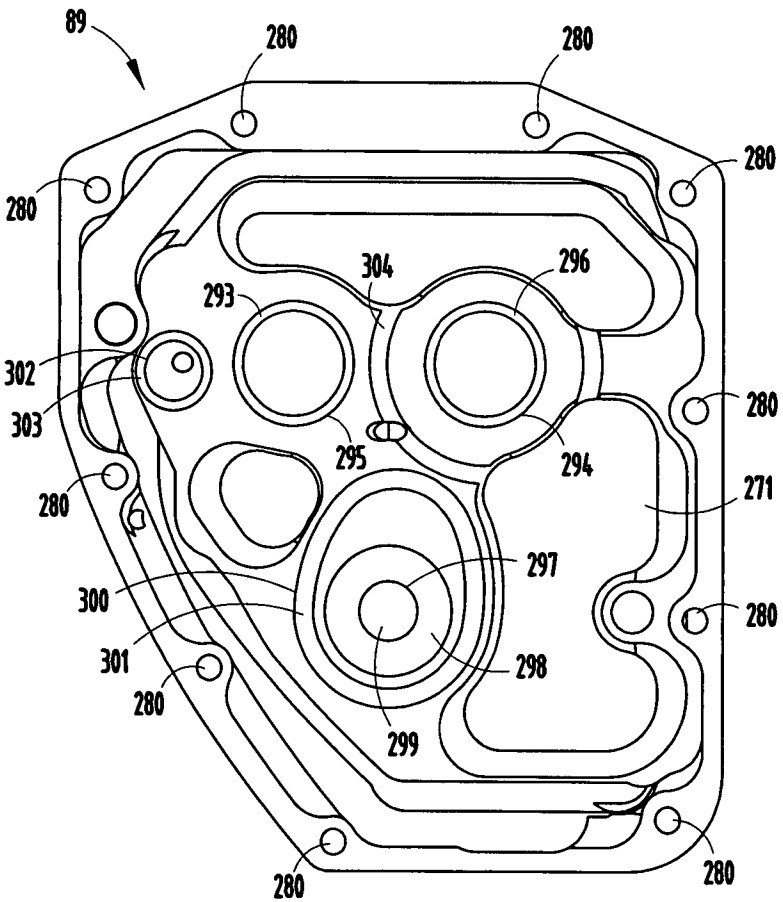
FIG. 32 is an elevational view of an interior side of the cover.

The recessed interior surface 271 (FIGS. 32 and 33) of cover 89 includes an interior sidewall 292, which is shaped to receive body 9 and body cover plate 88 therein. More specifically, the interior surface 271 of cover 89 includes two cup-shaped circular apertures 293 and 294 disposed generally concentric with the central axes of camshafts 5 and 6 respectively. As best illustrated in FIG. 32, bushings 295 and 296 are press fit into apertures 293 and 294, and are configured to receive the right-hand ends 57 and 63 of camshafts 5 and 6 therein, and rotatably support the same in cover 89. The interior surface 271 of cover 89 also includes a third cup-shaped recess or aperture 297 disposed vertically below apertures 293 and 294, and axially aligned with the central axis of the end portion 45 of pinion shaft 4. Recess 297 includes an enlarged, circular outer portion 298 having a diameter slightly larger than that of pinion gear 13 to provide clearance for the same, as well as a circular, indented central portion 299, which provides clearance for the head of lock bolt 338, which attaches pinion gear 13 to the end portion 45 of pinion shaft 4. An ovate channel 300 extends about recess 297, and is adapted to receive therein a pinion shaft O-ring seal 301, which seals against the exterior face 253 of cover plate 88, as described below. Furthermore, a circular counter bore 302 extends about oil port 260*a*, and receives an O-ring 303 therein, which also seals against the exterior face 253 of cover plate 88. Finally, a quarter circular groove 304 extends around the cam bushing oil feed aperture 294, and adapts cover 89 for use in alternative applications.

Figure 34:
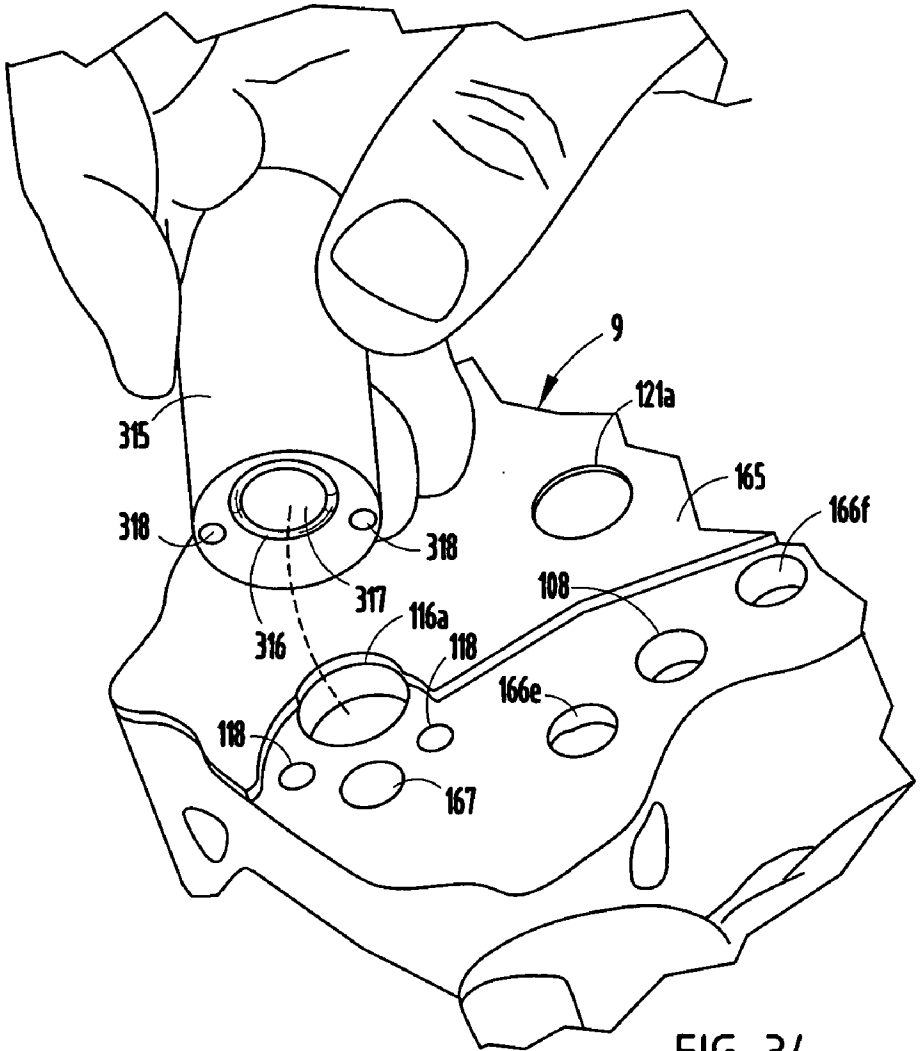
FIG. 34 is a fragmentary, perspective view of the oil pump body, shown with a flywheel cavity return fitting being installed thereon.

Oil pump assembly 1 is preferably assembled in the following manner. With reference to FIGS. 1 and 34, flywheel cavity return fitting 315 is mounted on the left-hand or interior face 165 of oil pump body 9 in the following manner. An O-ring seal 316 is positioned about the central passageway 317 of fitting 315 at the right-hand end thereof, and the assembly is positioned on the interior face 165 of body 9, such that return port 167 aligns with central passageway 317, and fastener apertures 118 align with mating threaded apertures 318 in the right-hand end of fitting 315. Cap screws 319 are then installed through fastener apertures 118 and into threaded apertures 318 to securely retain fitting 315 on the interior face 165 of body 9 in the manner best shown in FIG. 14B.

Alignment dowels 109 and 109' are then mounted in apertures 75 and 75' of crankcase 3, such that the same protrude slightly from the face 70 of crankcase 3. Two thread adapters 110 are then screwed into the crankcase 3 through dowels 109 and 109' in the manner shown in FIG. 34A. With reference to FIG. 1, reed valve 322 is then installed over pinion shaft 4, with the associated O-ring seal thereon being seated in crankcase 3. Spring 324 is slid into a counter bore on the right-hand side of reed valve 322, and rests on pinion shaft 4. With reference to FIG. 6, O-ring seal 316 is then positioned in crankcase boss 77 to mate with the left-hand end of fitting 315. O-ring seals 326 are also installed in crankcase ports 74*a*, 74*b*, 74*c*, 74*d*, 74*e*, 74*f* and 74*g*.

Figure 34B:
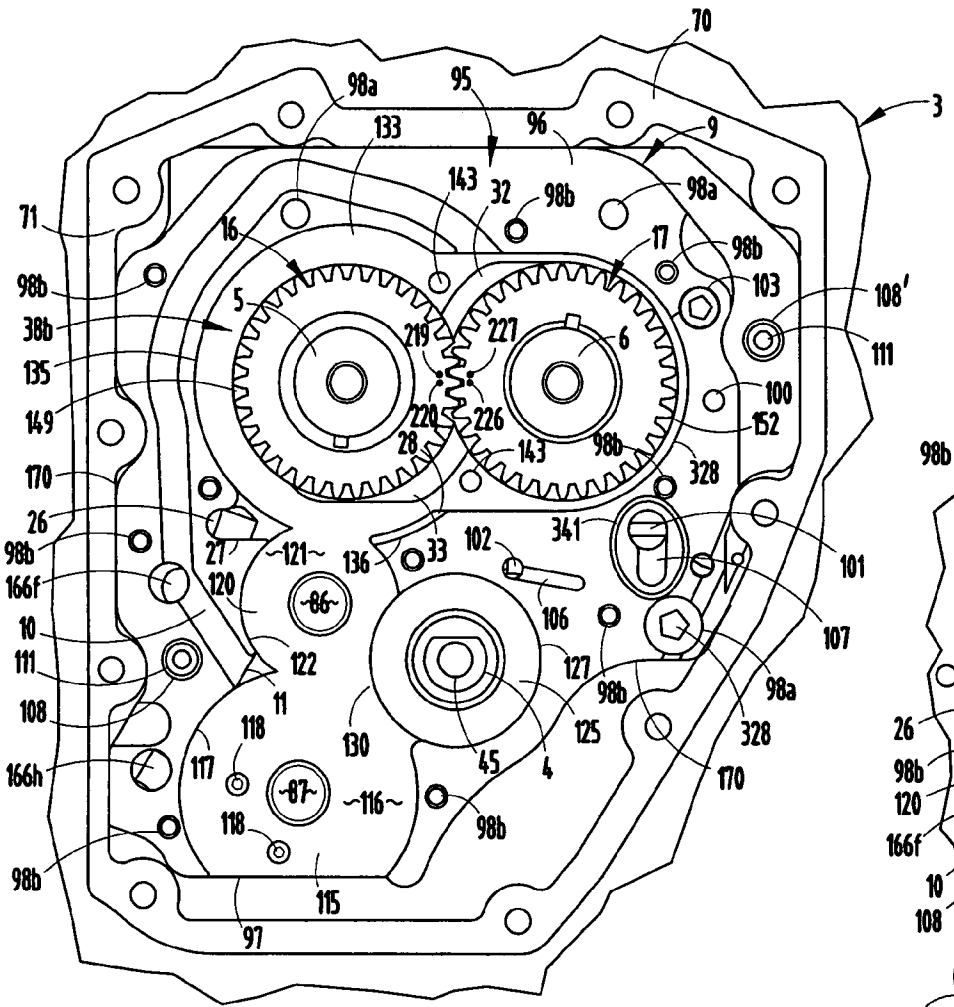
FIG. 34B is a front elevational view of the oil pump body, shown attached to the crankcase, with the rear and front cam drive gears installed therein.

Lubrication is then applied to pinion shaft 4, and oil pump body 9 is slid over the pinion shaft just enough to contact reed valve spring 324. Oil pump body 9 is then shifted into position on the outer face 70 of crankcase 3, such that front and rear alignment dowels 109 and 109' are received into the mating apertures 108 and 108' in body 9. A flathead cap screw 328 (FIG. 34B) is installed in the countersunk hole 98*a* disposed immediately below pressure relief passageway 101, as shown in FIG. 34B.

Figure 35:
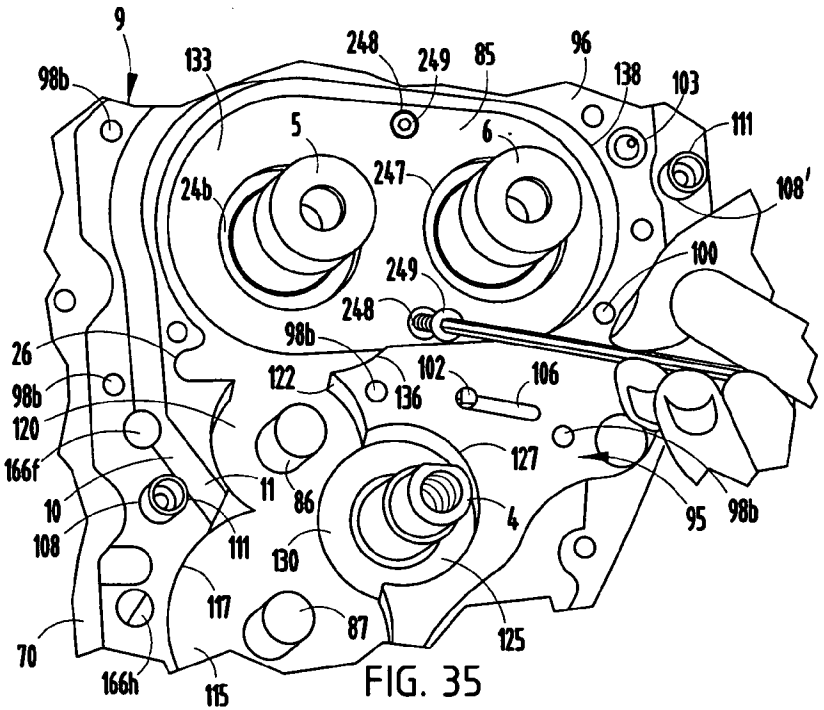
FIG. 35 is a front elevational view of the oil pump body, shown attached to the crankcase, with the divider plate being mounted in place.

The second and third cam drive gears 16 and 17 are pressed onto the cylindrical mounting surfaces 58 and 62 of rear and front camshafts 5 and 6 using conventional keys which lock into the keyways 216 and 223 in gears 16 and 17, such that second cam drive gear 16 rotates with rear camshaft 5, and third cam drive gear 17 rotates with front camshaft 6. Camshafts 5 and 6 are lubricated, and the left-hand ends 54 and 60 of camshafts 5 and 6 are then inserted through the ovate apertures 150 and 153 in body 9, and are closely received into the bearings 330 mounted in apertures 55 and 61 of crankcase 3. The ovate shape of body apertures 150 and 153 permits the lobes 53 and 59 on camshafts 5 and 6 to pass therethrough, and thereby reduce assembly time and effort. The second and third cam drive gears 16 and 17 are sequentially received closely within recesses 146 and 147, and the teeth 217 and 224 of cam drive gears 16 and 17 are intermeshed with their timing marks 219 and 227 and 220 and 226 arranged in a laterally aligned relationship, as shown in FIG. 34B. More specifically, the timing mark 219 on gear 16 aligns with the timing mark 227 on gear 17, and the timing mark 220 on gear 16 aligns with the timing mark 226 on gear 17. The noted timing mark arrangement permits identical gears to be used for gears 16 and 17. Lubricant is then applied to the rear or left-hand side 243 of divider plate 85, and the divider plate is then positioned over camshafts 5 and 6, and into oval recess 138, and then attached to body 9 using fasteners 249, which extend through fastener apertures 248 in divider plate 85, and into mating threaded apertures 143 in the body 9, as shown in FIG. 35.

Figure 37:
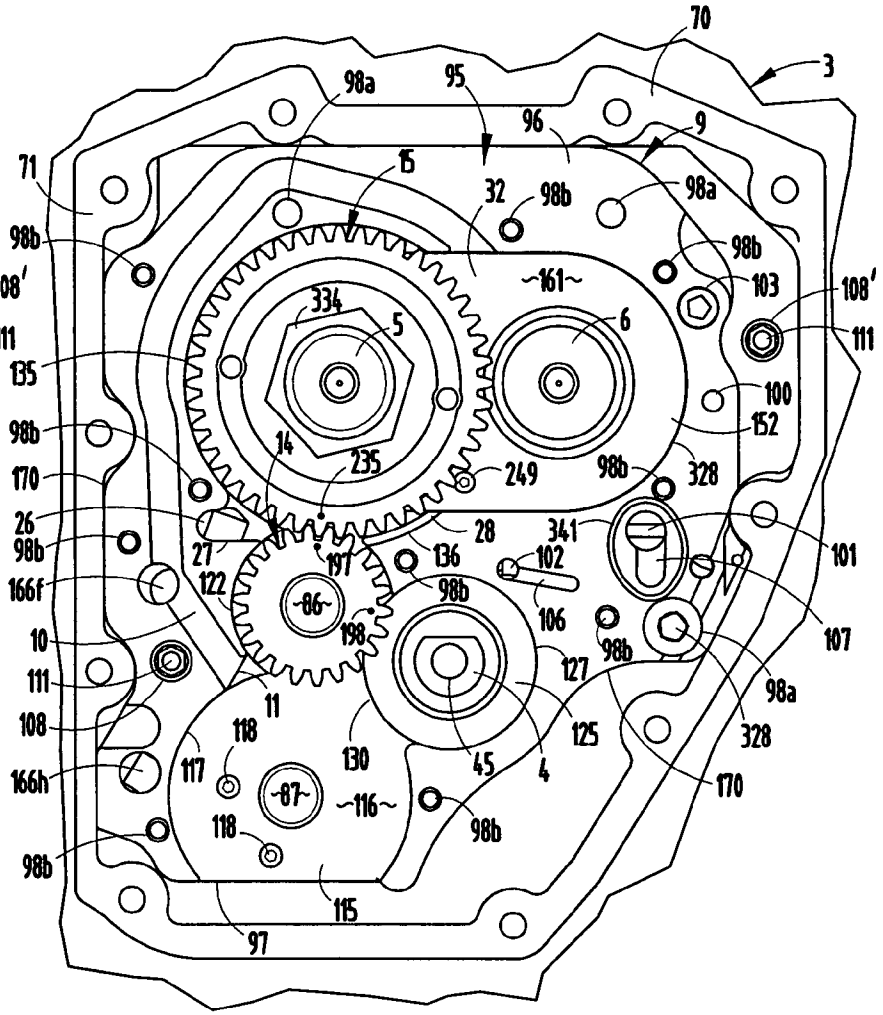
FIG. 37 is a front elevational view similar to FIG. 36, with the idler gear installed in the assembly.
Figure 36:
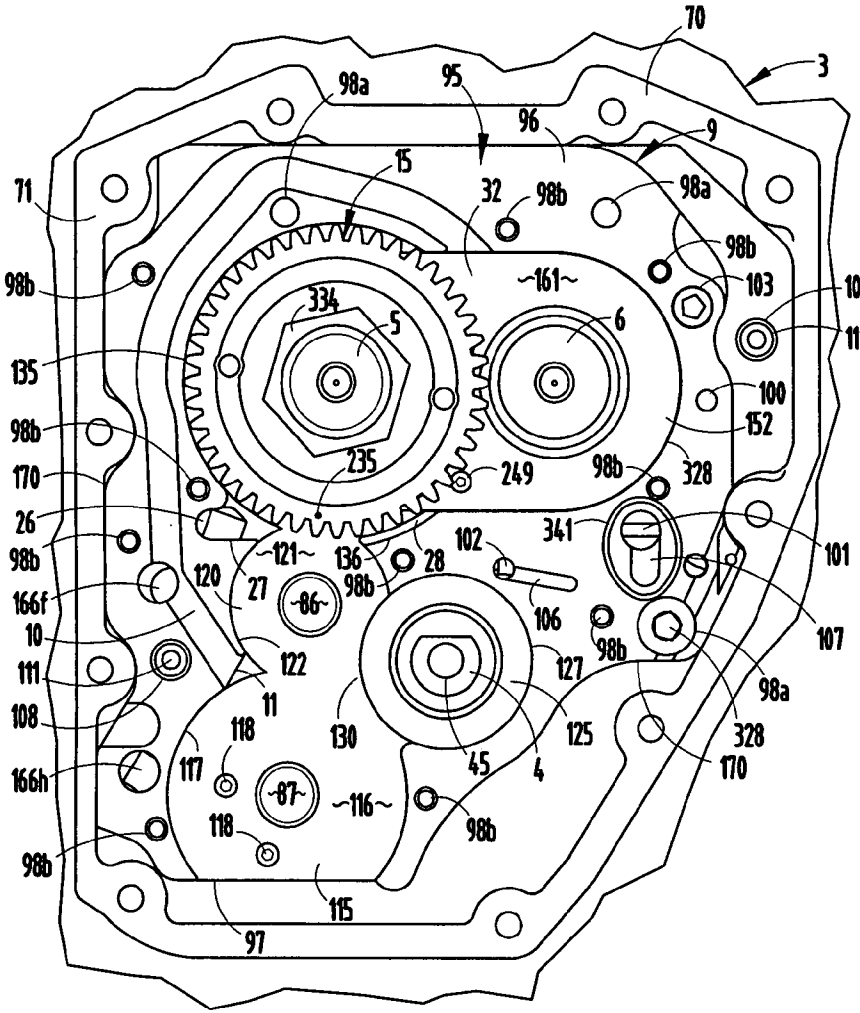
FIG. 36 is a front elevational view of the oil pump body, shown attached to the crankcase, with the first cam drive gear installed on the rear camshaft.
Figure 38:
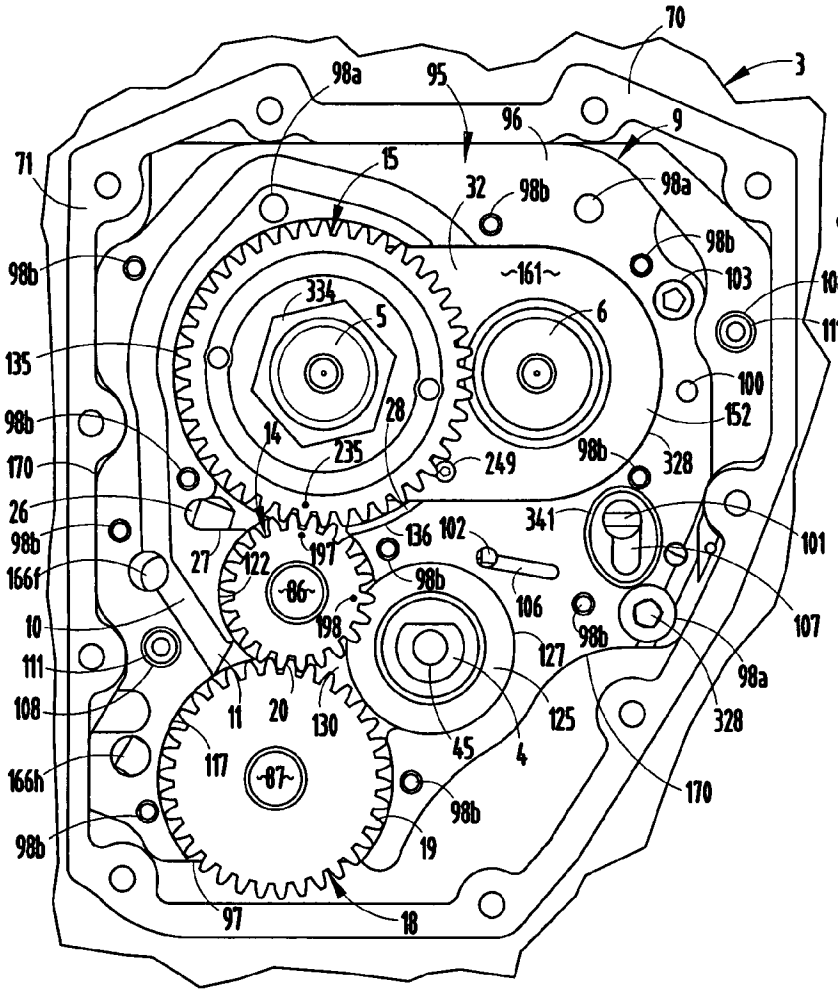
FIG. 38 is a front elevational view similar to FIGS. 36 and 37, with the cam chest return gear installed in the assembly.

First cam drive gear 15 is then installed on the right-hand support surface 56 of rear camshaft 5 using a gear spacer 333, which slides over the key (not shown) on rear camshaft 5, which is received in gear keyway 238, along with a retainer nut 334, which mates with the threaded end portion (not shown) of rear camshaft 5 in the manner shown in FIG. 36, so that first cam drive gear 15 rotates with rear camshaft 5. Rear camshaft 5 is then rotated until the cam drive gear timing mark 235 on gear 15 is oriented downwardly. With the left-hand end of idler gear shaft 86 pressed into body 9, and the right-hand end of shaft 86 lubricated, idler gear 14 is then positioned on idler gear shaft 86, as shown in FIG. 37, such that idler gear 14 is closely received within recess 120, and the associated timing mark 197 aligns with the timing mark 235 on cam drive gear 15. The teeth 202 on idler gear 14 will intermesh with the teeth 239 on cam drive gear 15. With the left-hand end of cam chest return gear shaft 87 pressed into body 9, and the right-hand end of shaft 87 lubricated, cam chest return gear 18 is then assembled on cam return gear shaft 87, as shown in FIG. 38, such that cam chest return gear 18 is closely received within recess 115 in body 9. The teeth 231 on cam chest return gear 18 are intermeshed with the teeth 202 on idler gear 14. As discussed above, when cam chest return gear 18 is installed in body 9, the lower portion 19 thereof protrudes downwardly from the bottom edge 97 of body 9 into at least a portion of the cam chest sump 7.

Figure 39:
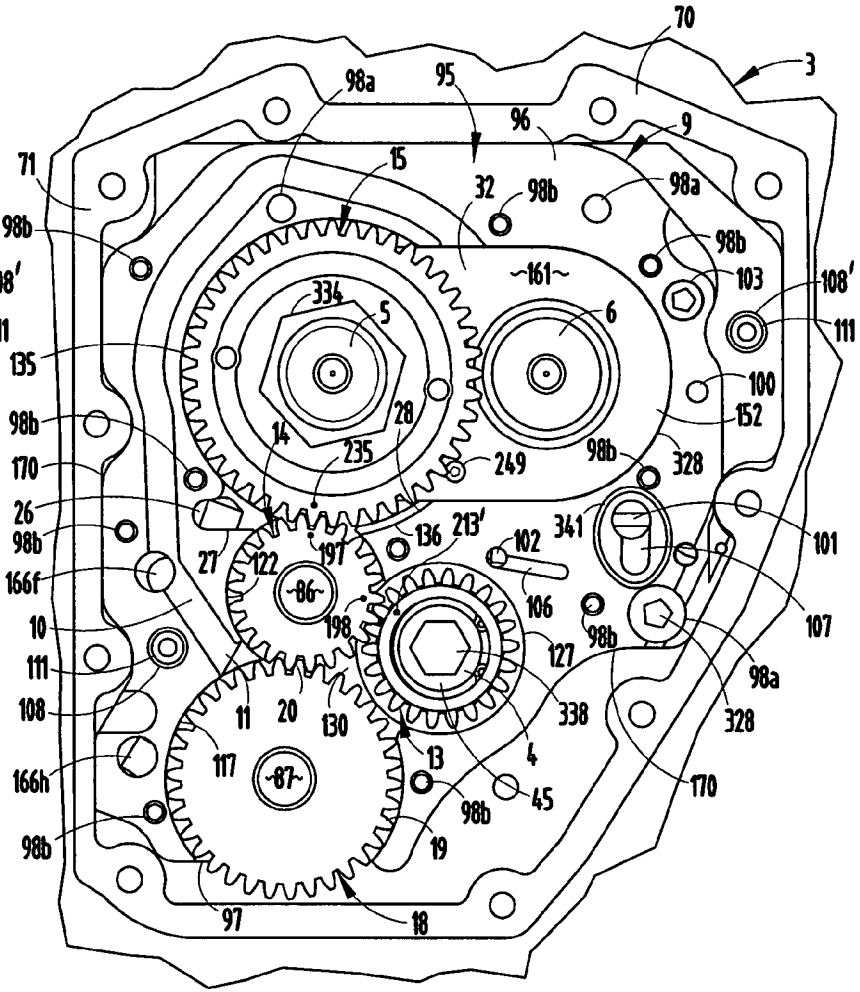
FIG. 39 is a front elevational view similar to FIGS. 36–38, with the pinion gear shown installed in the assembly.

Pinion shaft 4 is then rotated so that the flat on outer end 45 is oriented upwardly. With the timing mark 213' on pinion gear 13 aligned with the timing mark 198 on idler gear 14, pinion gear 13 is mounted on the outer end 45 of pinion shaft 4 using washer 204, retainer ring 205, and lock bolt 338, as shown in FIGS. 1 and 39. Ball 206 is received in the mating recesses in pinion gear 13 and washer 204. An O-ring seal 341 (FIG. 39) is then installed in body 9 around pressure regulating passage 107, and lubricant is applied to all of the faces of gears 13–18.

Figure 7C:
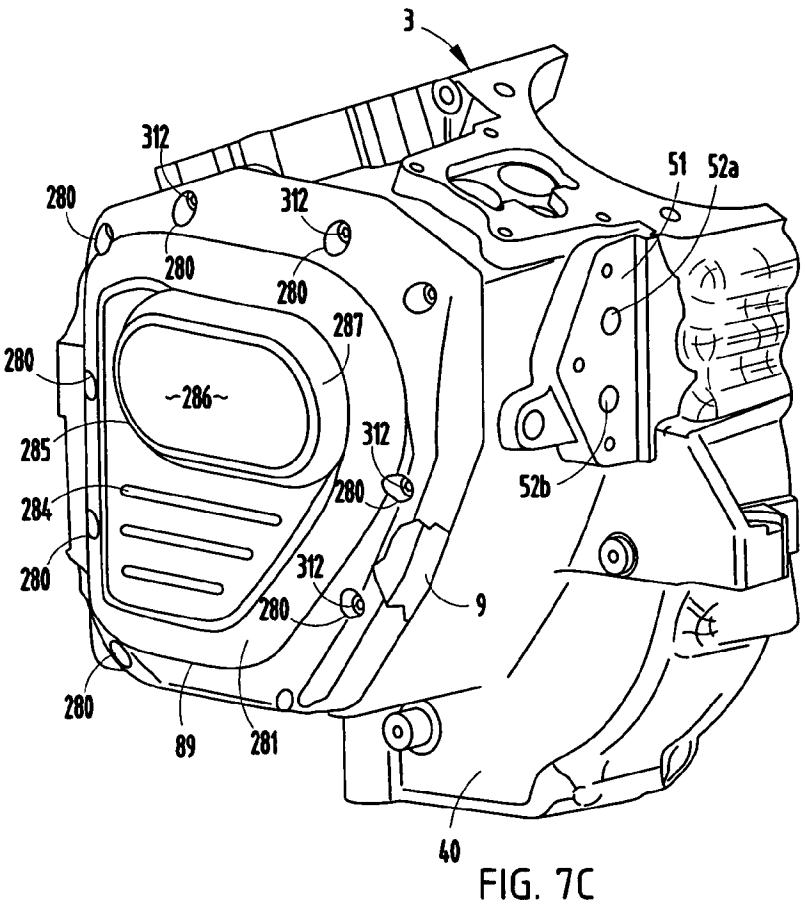
FIG. 7C is a perspective view of the crankcase and integrated cam drive and oil pump assembly of FIG. 7B, taken from an opposite side thereof.
Figure 7B:
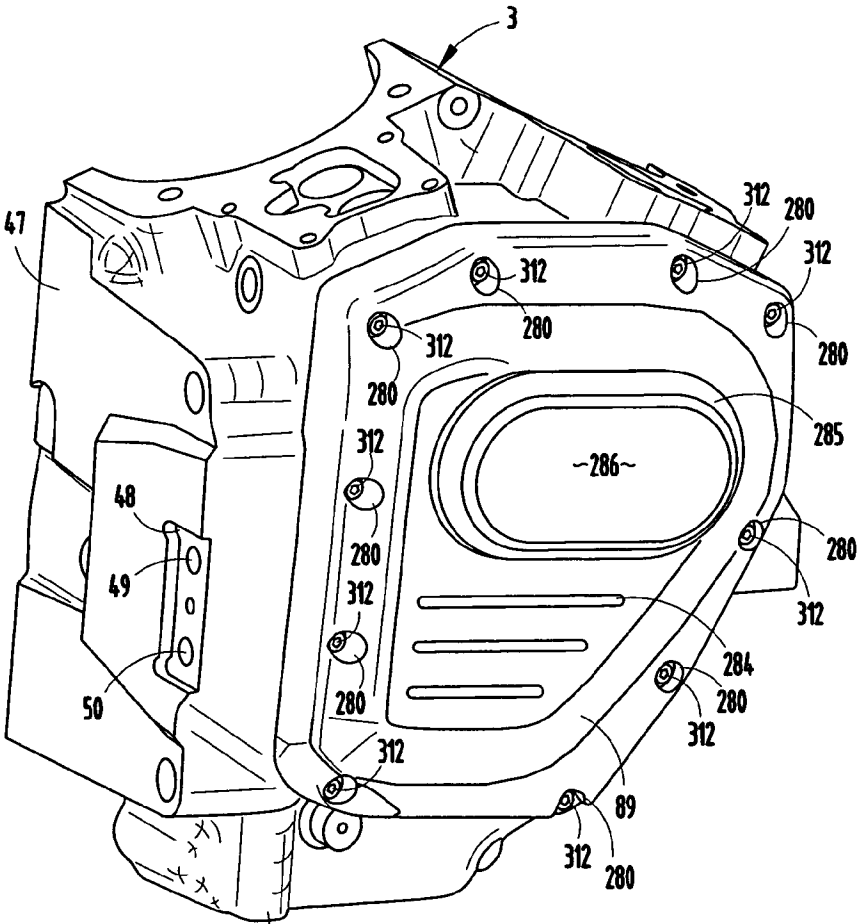
FIG. 7B is a perspective view of the crankcase with the integrated cam drive and oil pump assembly installed thereon.
Figure 40:
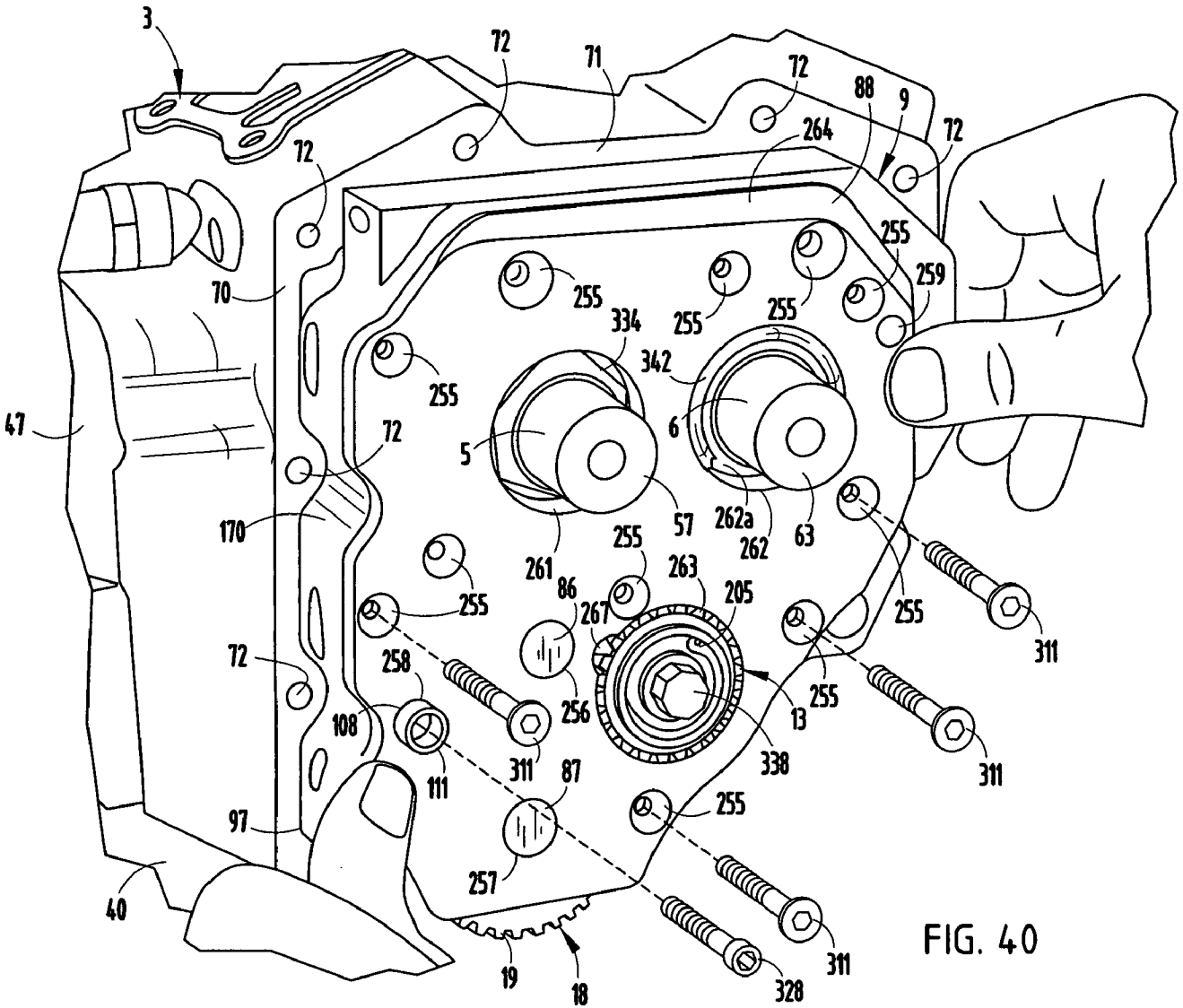
FIG. 40 is a perspective view similar to views 36–39, shown with the body cover plate being installed on the assembly.

With reference to FIG. 40, cover plate 88 is then positioned over the exterior face 95 of oil pump body 9, such that the two locating dowels 111 and 104 are received in apertures 258 and 259 of cover plate 88 to locate the same on oil pump body 9. The right-hand ends of camshafts 5 and 6 protrude from cover plate apertures 261 and 262, and the lock bolt 338 attaching pinion gear 13 to the outer end 45 of pinion shaft 4 protrudes slightly outwardly from cover plate aperture 263. Cover plate 88 is then attached to oil pump body 9 using twelve flat head screws 311, which extend through fastener apertures 255 in cover plate 88. Two of the flat head screws are relatively long, and extend through cover plate apertures 255, as well as mating body apertures 98*a*, and anchor in the threaded fastener apertures 73 in the face 70 of crankcase 3. The remaining ten flat head screws are shorter, and extend through cover plate apertures 255, and anchor in the threaded apertures 98*b* of body 9, as shown in FIG. 40. O-ring seal 342 is then installed in the associated counter bore 262*a* around front camshaft 6, as shown in FIG. 40. Gasket 343 (FIG. 1) is then positioned over body 9 onto the rim 71 of crankcase 3. The O-rings 301 and 303 are installed in the mating channel 300 and counter bore 302 on the interior side of cover 89 in the manner shown in FIGS. 32 and 33, and the outer ends 57 and 63 of camshafts 5 and 6 are lubricated. Cover 89 is then positioned over the assembled body 9 and cover plate 88, so as to completely enclose oil pump assembly 1 in the manner shown in FIGS. 7B and 7C. The right-hand ends 57 and 63 of camshafts 5 and 6 are rotatably received in bushings 295 and 296 in the interior surface 271 of cover 89, and the lock bolt 338 attaching pinion gear 13 to the outer end 45 of pinion shaft 4 extends into recess 297. Cover 89 is then attached to the exterior face 70 of crankcase 3 using ten cover screws 312 which extend through cover apertures 280, as well as mating apertures in gasket 343, and are anchored in threaded fastener apertures 72 in the face 70 of crankcase 3. As fasteners 312 are tightened, the O-rings 301, 303 and 342 between cover 89 and cover plate 88 are compressed to form seals therebetween for purposes described in greater detail below.

In operation, oil pump assembly 1 scavenges oil from cam chest sump 7 and crankcase sump or flywheel cavity 25 in the following manner. With reference to FIG. 4, pinion gear 13 is rotated by pinion shaft 4 in a clockwise direction, as shown by the associated arrow. The teeth 210 of pinion gear 13 are intermeshed with the teeth 202 of idler gear 14, which is thereby rotated in a counterclockwise direction, as shown by the associated arrow in FIG. 4. The teeth 202 of idler gear 14 are intermeshed with the teeth 239 of first cam drive gear 15, which thereby rotates first cam drive gear 15 in a clockwise direction, as noted by the associated arrow in FIG. 4. Rear camshaft 5 is thereby rotated in a clockwise direction, which in turn also rotates second cam drive gear 16 (FIG. 5), which is mounted at the opposite end of rear camshaft 5, in a clockwise direction, as noted by the associated arrows in FIGS. 4 and 5. Rear camshaft 5 is thereby rotated axially to control the valve train associated with engine 2. Referring again to FIG. 5, the teeth 217 of second cam drive gear 16 are intermeshed with the teeth 224 of third cam drive gear 17, which rotates the third cam drive gear in a counterclockwise direction, as noted by the associated arrow in FIG. 5. Since third cam drive gear 17 is coupled to front camshaft 6, front camshaft 6 is similarly rotated axially in a counterclockwise direction to control the associated valve train of engine 2.

With reference to FIG. 4, the teeth 202 of idler gear 14 are also intermeshed with the teeth 231 of cam chest return gear 18, thereby rotating cam chest return gear 18 in a clockwise fashion, as noted by the associated arrow in FIG. 4. As the teeth 231 on the lower portion 19 of cam chest return gear 18 pass through cam chest sump 7, the spaces 232 between teeth 231 are filled with sump oil, which is then drawn upwardly in a clockwise direction into the outer periphery of recess 115, along sidewall 117, such that the oil in the spaces 232 between teeth 231 and sidewall 117 is positively displaced in a clockwise direction toward the intermeshed portions of gears 14 and 18, and scavenge pump outlet 11. As the teeth 231 on cam chest return gear 18 mesh with the teeth 202 on idler gear 14, the oil in the spaces 232 between the teeth 231 on cam chest return gear 18 is positively displaced to flow the oil from scavenge pump outlet 11 through oil passageway 10 to port 74*f* and oil reservoir 8. To assist in the scavenging of oil from cam chest sump 7, the teeth 231 on cam chest return gear 18 are machined precisely for very close reception within recess 115, and mate closely with sidewall 117 to create a seal therebetween. Similarly, the teeth 202 on idler gear 14 are machined precisely for very close reception in recess 120, so that the tips of teeth 202 are disposed very close to sidewall 122 to create a seal therebetween. Furthermore, the annular space 129 between the exterior surfaces of teeth 210 on pinion gear 13 and sidewall 127 serves to join or communicate recesses 115, 120 and 125. As the teeth 231 of cam chest return gear 18 separate or diverge from the teeth 202 of idler gear 14, a vacuum is created in the common portion 130 of recesses 115, 120 and 125, which communicates with the spaces 232 between the teeth 231 on cam chest return gear 18 along the upper, right-hand side thereof (as viewed in FIG. 4). This vacuum is captured between the spaces 232 between teeth 231 on cam chest return gear 18, and shifts along with cam chest return gear 18 in a clockwise fashion, along the return portion of sidewall 117, until the associated teeth 231 clear the bottom of sidewall 117, at which point, the captured vacuum sucks or draws oil upwardly from cam chest sump 7 into the spaces 232 between the teeth 231 on cam chest return gear 18 to greatly enhance scavenging efficiency. The scavenged oil is then drawn around the left-hand portion of cam chest return gear 18 (as oriented in FIGS. 4 and 5), along the sidewall 117, and is displaced between the intermeshed teeth 231 and 202 of cam chest return gear 18 and idler gear 14 to flow the oil through the cam chest scavenge portion of oil passageway 10, through port 74*f*, and back into oil reservoir 8 in the direction of the arrow in FIG. 4. O-ring seal 301 in cover 89 seals the annular space 129 of body 9 to insure adequate suction along cam chest return gear 18.

With reference to FIG. 4, oil is scavenged from crankcase sump or flywheel cavity 25 in the following manner. The flywheel cavity 25 communicates with the crankcase scavenge pump inlet 27 through fitting 315 and passageway 183. The teeth 239 on first cam drive gear 15 are precisely machined to be closely received within recess 133 (except at relief 136), such that the tips of teeth 239 mate closely with that portion of sidewall 135 between intermeshed gears 14 and 15, and oil cavity 161. Crankcase scavenge oil at the pump inlet 27 is picked up in the spaces 240 between the teeth 239 on first cam drive gear 15, and is displaced in a clockwise direction around sidewall 135 into the oil cavity 161 disposed between divider plate 85 and cover plate 88, so as to fill the same with oil, and draw the oil toward pump outlet 28. The scavenged oil at the lower portion of oil cavity 161, along relief 136, lodges in the spaces 240 between teeth 239 on first cam drive gear 15. As the teeth 239 of first cam drive gear 15 mesh with the teeth 202 on idler gear 14, the flywheel cavity scavenge oil is displaced, causing the same to flow from pump outlet 28, through oil cavity 161, passageway 10, and port 74*f*, and back to oil reservoir 8. Crankcase scavenge oil at the pump inlet 27 is also picked up in the spaces 203 between the teeth 202 on idler gear 14, and is carried in a counterclockwise direction around sidewall 122 to the cam scavenge pump outlet 11 and intermeshed teeth 202 and 231 of idler gear 14 and cam chest return gear 18, where the oil is displaced, and flows with the cam chest sump scavenge oil through passageway 10, into port 74*f*, and back to oil reservoir 8.

With reference to FIGS. 2, 3 and 5, supply oil is drawn from oil reservoir 8, and flowed through filter 34 and engine 2 to lubricate the various engine parts in the following manner. Oil from oil reservoir 8 is communicated with the inlet pocket 33 in oil pump body 9 by oil passageways 181 and 182. The supply oil in inlet pocket 33 is captured in the spaces 218 between teeth 217 on second cam drive gear 16 and is transported in a clockwise direction therebetween along sidewall 149 to outlet pocket 32. As the teeth 217 on second cam drive gear 16 mesh with the teeth 224 on third cam drive gear 17, the oil in the spaces 218 between teeth 217 is positively displaced outwardly into outlet pocket 32, thereby pressurizing the supply oil in outlet pocket 32 and flowing the same to oil filter 34.

The reference numeral 1' (FIGS. 41–43) generally designates another embodiment of the present invention, having a pressure relief valve 346 disposed operably between supply pump 38 and oil filter 34, which serves to alleviate pressure spikes at the oil pressure gauge (not shown) on motorcycle 21 during cold start, and other similar conditions. Since integrated cam drive and oil pump assembly 1' is similar to the previously described assembly 1, similar parts appearing in FIGS. 1–40 and 41–43 respectively are represented by the same, corresponding reference numerals, except for the suffix "'" in the numerals of the latter. With reference to FIGS. 41–43, the illustrated oil pump body 9' includes a pressure relief passageway 347 which extends between the outlet pocket 32' of supply pump 38' and the oil cavity 166' defined between divider plate 85' and cover plate 88' and surrounding the outer end of front camshaft 6'. Pressure relief valve 346 is disposed in passageway 347, and in the illustrated embodiment, comprises a sphere or ball 348 which mates with a circularly-shaped valve seat 349 formed at the end of passageway 347. A coil spring 350 extends between cover plate 88' and ball 348 to resiliently urge ball 348 against valve seat 349 to normally close passageway 347. A screw 351 is threadably mounted in cover plate 88', and supports the forward end of spring 350. In the illustrated example, rotation of screw 351 varies the resilient force applied by spring 350 to ball 348.

In operation, pressure relief valve 346 functions in the following manner. Oil from the outlet pocket 32' of supply pump 38' communicates with passageway 347 and normally flows through pump body 9' to the oil filter. In the event the pressure at the outlet pocket 32' of supply pump 38' exceeds a predetermined amount, the hydraulic pressure acting on that portion of the interior side of ball 348 within valve seat 349 creates sufficient force to overcome the resilient force of spring 350, thereby shifting valve ball 348 outwardly off of valve seat 349, thereby permitting the pressurized oil to flow from passageway 347 into oil cavity 166'. The opening of valve ball 348 reduces the pressure of the supply oil and alleviates pressure spikes at the oil pressure gauge (not shown) on the motorcycle during cold start, and other similar conditions. The oil which spills into oil cavity 166' is recirculated back to the oil reservoir 8.

The oil pump body 9' illustrated in FIG. 41 also includes a relatively shallow recess or pocket 355 disposed in the base wall 121' of idler gear recess 120' and the base wall 134' of first cam drive gear recess 133' adjacent the intermeshed portions of the first cam drive gear and the idler gear (not shown) at the converging side thereof. Pocket 355 has an elongate shape and is disposed at a slight angle immediately adjacent to the outlet pocket 32' of supply pump 38'. Pocket 355 serves to improve the pumping efficiency of scavenge pump 37', and also reduces noise generated during the operation of the scavenge pump 37'. In the illustrated example, pocket 355 includes a downwardly extending leg 356 which provides lubrication to idler gear shaft 86'.

The pump body 9' illustrated in FIG. 41 also includes a second relatively shallow recess or pocket 360, which is located in the base wall 116' of cam chest return gear recess 115' and the base wall 121' of idler gear recess 120' at the intermeshed portions of the cam chest return gear and the idler gear (not shown) at the converging side thereof. The illustrated pocket 360 has an elongate shape, is oriented at a slight downward angle, and communicates with scavenge pump outlet 11'. Like pocket 355, pocket 360 also serves to improve pumping efficiency and reduce noise generated as a consequence of the pumping action of the scavenge pump 36'.

The pump body 9' shown in FIG. 41 also includes a modified port 102' and slot 106' arrangement with a vertically extending slot 362 at the forward end of slot 106'. The upper portion of slot 362 forms an air seal for the oil supply pump, and the lower portion of slot 362, which extends below slot 106' forms a debris trap.

The integrated cam drive and oil pump assembly 1 is particularly adapted for use in conjunction with the illustrated high performance motorcycle engine 2, and adapts the associated cam drive gear trains to perform oil pumping operations which take the place of separate gerotor pumps or other similar oil pumps, and provides a more positive type of oil pump displacement for supplying filtered oil to the engine, and also improves scavenging from both the cam chest sump 7 and crankcase sump 25. The functional billet style cover 89 supports the outer ends of camshafts 5 and 6, and also provides a unique appearance to engine 2. The integrated cam drive and oil pump assembly 1 also regulates oil pressure after the filter 34 to provide more consistent pressure through a wide range of engine temperatures and environments, such as cold starts, filter obstructions, etc., such that oil pressure to the various lubricated engine parts remains virtually the same at all times. The integrated cam drive and oil pump assembly 1 can provide larger volumes of oil than stock oil pumps, which permit it to better maintain oil pressure under various conditions, such as hot idle and cold start. The portless nature of the cam chest sump scavenge pump 36 alleviates clogging, and other similar problems. Furthermore, the increased scavenging capacity of integrated cam drive and oil pump assembly will pump more oil out of the engine 2 and back to oil reservoir 8, so as to reduce the problems associated with lost power and heat buildup due to excess oil in the crankcase. Integrated cam drive and oil pump assembly 1 further reduces oil carryover or blow by.

In the foregoing description, it will be readily appreciated by those skilled in the art that modifications may be made to the invention without departing from the concepts disclosed herein. Such modifications are to be considered as included in the following claims, unless these claims, by their language, expressly state otherwise.

The invention claimed is as follows:

1. In a motorcycle engine having a crankcase, a drive shaft, first and second camshafts, a cam sump, and an oil reservoir, the improvement of an integrated cam drive and oil pump assembly, comprising:

an oil pump body operably connected with said crankcase, and including an oil passageway having a pump outlet portion thereof communicating with said oil reservoir, and a generally open interior receiving said drive shaft therein;

a drive gear disposed in the interior of said oil pump body, and operably connected with said drive shaft for rotation therewith;

an idler gear rotatably supported in the interior of said oil pump body, and matingly engaging said drive gear for rotation therewith;

a first cam drive gear disposed in the interior of said oil pump body, being operably connected with said first camshaft for rotation therewith, and matingly engaging said idler gear to axially rotate said first camshaft;

a second cam drive gear operably connected with said first camshaft at a location spaced axially apart from said first cam drive gear, and rotating with said first camshaft;

a third cam drive gear operably connected with said second camshaft for rotation therewith, and matingly engaging said second cam drive gear to axially rotate said second camshaft; and a cam chest return gear rotatably supported in the interior of said oil pump body, and having a first portion thereof extending into a portion of said cam sump to draw oil therefrom, and a second portion thereof matingly engaging said idler gear at a location adjacent to said pump outlet portion of said oil passageway, such that oil drawn from said cam sump by said cam chest return gear is displaced between said cam chest return gear and said idler gear to flow the oil from said cam sump, through said oil passageway, and into said oil reservoir.

2. A motorcycle engine as set forth in claim 1, including:

a crankcase sump; and wherein said oil passageway defines a first passageway; and said oil pump body includes a second passageway having a pump inlet portion thereof communicating with said oil reservoir, and a pump outlet portion thereof disposed adjacent to matingly engaged portions of said idler gear and said first cam drive gear at a converging side thereof to convey oil from the crankcase sump between said idler gear and said first cam drive gear and thereby flow the oil from said crankcase sump, through said second passageway, and into said oil reservoir.

3. A motorcycle engine as set forth in claim 2, wherein:

said pump inlet portion of said second passageway is disposed adjacent to said matingly engaged portions of said idler gear and said first cam drive gear at a diverging side thereof, whereby oil from said crankcase sump is also drawn around a portion of said idler gear and is displaced between said idler gear and said cam chest return gear to flow the oil through said first passageway, and into said oil reservoir.

4. A motorcycle engine as set forth in claim 3, wherein:

said oil pump body includes an inlet pocket communicating with said oil reservoir, and disposed adjacent to matingly engaged portions of said second cam drive gear and said third cam drive gear at a diverging side thereof to draw oil from said oil reservoir and displace the oil between said second and third cam drive gears to flow the oil through said engine.

5. A motorcycle engine as set forth in claim 4, including:

a cover operably connected with said crankcase and enclosing said oil pump body, and defining at least a portion of said cam sump.

6. A motorcycle engine as set forth in claim 5, wherein:

said cover includes first and second bushings mounted on an interior portion thereof which rotatably support therein outer ends of said first and second camshafts.

7. A motorcycle engine as set forth in claim 6, wherein:

said cam chest return gear includes a plurality of peripheral teeth; and said oil pump body includes a cam chest return gear recess, which is defined by a first sidewall, opens to said exterior face of said oil pump body, and closely receives a portion of said cam chest return gear therein; said first sidewall includes an open bottom portion through which said teeth on said second portion of said cam chest return gear protrude into said cam sump, such that said cam chest return gear picks up oil in said cam sump and positively displaces the same between said teeth of said cam chest return gear and said first sidewall of said cam chest return gear recess to remove oil directly from said cam sump without requiring an inlet port.

8. A motorcycle engine as set forth in claim 7, including:

a divider plate disposed axially between said first cam drive gear and said second cam drive gear, and isolating said pocket from said first passageway.

9. A motorcycle engine as set forth in claim 8, including:

an outlet pocket disposed adjacent to said matingly engaged portions of said second cam drive gear and said third cam drive gear at a converging side thereof.

10. A motorcycle engine as set forth in claim 9, wherein:

said oil pump body includes a generally open exterior face oriented away from said crankcase, and configured to insert said drive gear, said idler gear and said first, second and third cam drive gears therethrough into said interior of said oil pump body.

11. A motorcycle engine as set forth in claim 10, including:

a body cover plate operably connected with said oil pump body and enclosing predetermined portions of said generally open exterior face of said oil pump body.

12. A motorcycle engine as set forth in claim 11, wherein:

said divider plate and said body cover plate define a first cavity therebetween in which said idler gear and said cam chest return gear are disposed.

13. A motorcycle engine as set forth in claim 12, wherein:

said divider plate and said oil pump body define a second cavity therebetween in which said second and third cam drive gears are disposed.

14. A motorcycle engine as set forth in claim 13, wherein:

said oil pump body includes a drive gear recess, which is defined by a second sidewall, communicates with said cam chest return gear recess, opens to said exterior face of said oil pump body, and receives said drive gear therein;

said cam chest return gear recess has a return portion extending between the diverging side of said matingly engaged portions of said cam chest return gear and said idler gear, and said open bottom of said first sidewall;

said idler gear and said cam chest return gears are configured to create a vacuum by the separation of said matingly engaged portions thereof; and including a seal extending around said drive gear recess, and positioned between said oil pump body and said cover, such that the vacuum created by the separation of said matingly engaged portions of said cam chest return gear and said idler gear communicates with spaces between said teeth on that portion of said cam chest return gear disposed in said return portion of said cam chest return gear recess to draw oil from said cam sump.

15. A motorcycle engine as set forth in claim 14, wherein:

said second passageway comprises an open channel extending around at least a portion of said first cam drive gear to form a seal between said oil pump body and said body cover plate.

16. A motorcycle engine as set forth in claim 15, wherein:

said oil pump body includes a second cam drive gear recess, which is defined by a third sidewall, opens to said exterior face of said oil pump body, and closely receives said second cam drive gear therein.

17. A motorcycle engine as set forth in claim 16, wherein:

said third sidewall defines at least a portion of said inlet pocket.

18. A motorcycle engine as set forth in claim 17, wherein:

said second cam drive gear recess includes an arcuate oil channel disposed along a base portion of said second cam drive gear recess to form a seal.

19. A motorcycle engine as set forth in claim 18, wherein:

said oil pump body includes a third cam drive gear recess, which is defined by a fourth sidewall, opens to said exterior face of said oil pump body, and closely receives said third cam drive gear therein.

20. A motorcycle engine as set forth in claim 19, including:

an oil filter communicating with said outlet pocket and filtering displaced oil flowing to said engine.

21. A motorcycle engine as set forth in claim 20, including:

an oil pressure controller operably disposed between said filter and said engine to regulate the pressure of the oil.

22. A motorcycle engine as set forth in claim 21, wherein:

said oil pump body includes a first generally ovate through opening disposed substantially concentric with said second cam drive gear recess to receive said first camshaft therethrough; and said oil pump body includes a second generally ovate through opening disposed substantially concentric with said third cam drive gear recess to receive said second camshaft therethrough.

23. A motorcycle engine as set forth in claim 22, including:

an idler gear shaft rotatably supporting said idler gear thereon and having one end thereof supported by said oil pump body, and an opposite end thereof extending into a mating aperture in said body cover plate.

24. A motorcycle engine as set forth in claim 23, including:

a cam chest return gear shaft rotatably supporting said cam chest return gear thereon and having one end thereof supported by said oil pump body, and an opposite end thereof extending into a mating aperture in said body cover plate.

25. An integrated cam drive and oil pump assembly for a motorcycle engine of the type having a crankcase, a drive shaft, a cam sump, and an oil reservoir, comprising:

an oil pump body adapted for operable connection with the crankcase, and including an oil passageway having a pump outlet portion thereof communicating with the oil reservoir, and a generally open interior configured to receive the drive shaft therein;

a drive gear disposed in the interior of said oil pump body, and adapted for operable connection with the drive shaft for rotation therewith;

an idler gear rotatably supported in the interior of said oil pump body, and matingly engaging said drive gear for rotation therewith;

first and second camshafts;

a first cam drive gear disposed in the interior of said oil pump body, operably connected with said first camshaft for rotation therewith, and matingly engaging said idler gear to axially rotate said first camshaft;

a second cam drive gear operably connected with the first camshaft at a location spaced axially apart from said first cam drive gear, and rotating with said first camshaft;

a third cam drive gear operably connected with the second camshaft for rotation therewith, and matingly engaging said second cam drive gear to axially rotate said second camshaft; and a cam chest return gear rotatably supported in the interior of said oil pump body, and having a first portion thereof extending into a portion of the cam sump to draw oil therefrom, and a second portion thereof matingly engaging said idler gear at a location adjacent to said pump outlet portion of said oil passageway, such that oil drawn from the cam sump by said cam chest return gear is displaced between said cam chest return gear and said idler gear to flow the oil from the cam sump, through said oil passageway, and into the oil reservoir.

26. An integrated cam drive and oil pump assembly as set forth in claim 25, wherein:

said oil passageway defines a first passageway; and said oil pump body includes a second passageway having a pump inlet portion thereof communicating with the oil reservoir, a pump outlet portion thereof disposed adjacent to matingly engaged portions of said idler gear and said first cam drive gear at a converging side thereof to convey oil from a crankcase sump between said idler gear and said first cam drive gear and thereby flow the oil from the crankcase sump, through said second passageway, and into the oil reservoir.

27. An integrated cam drive and oil pump assembly as set forth in claim 25, wherein:

said oil pump body includes an inlet pocket communicating with the oil reservoir, and disposed adjacent to matingly engaged portions of said second cam drive gear and said third cam drive gear at a diverging side thereof to draw oil from the oil reservoir and displace the oil between said second and third cam drive gears to flow the oil through the engine.

28. An integrated cam drive and oil pump assembly as set forth in claim 25, wherein:

said cam chest return gear includes a plurality of peripheral teeth; and said oil pump body includes a cam chest return gear recess, which is defined by a first sidewall, opens to an exterior face of said oil pump body, and closely receives a portion of said cam chest return gear therein; said first sidewall includes an open bottom portion through which said teeth on said second portion of said cam chest return gear protrude into the cam sump, such that said cam chest return gear picks up oil in the cam sump and positively displaces the same between said teeth of said cam chest return gear and said first sidewall of said cam chest return gear recess to remove oil directly from the cam sump without requiring an inlet port.

29. An integrated cam drive and oil pump assembly as set forth in claim 28, wherein:

said oil pump body includes a drive gear recess, which communicates with said cam chest return gear recess, opens to said exterior face of said oil pump body, and receives said drive gear therein;

said cam chest return gear recess has a return portion extending between the diverging side of said matingly engaged portions of said cam chest return gear and said idler gear, and said open bottom of said first sidewall;

said idler gear and said cam chest return gear are configured to create a vacuum by the separation of said matingly engaged portions thereof; and including a seal extending around said drive gear recess, such that the vacuum created by the separation of said matingly engaged portions of said cam chest return gear and said idler gear communicates with spaces between said teeth on that portion of said cam chest return gear disposed in said return portion of said cam chest return gear recess to draw oil from said cam sump.

30. An oil pump kit for a motorcycle engine of the type having a crankcase, a drive shaft, at least one camshaft, a cam sump, and an oil reservoir, comprising:

an oil pump body adapted for operable connection with the crankcase, and including an oil passageway having a pump outlet portion thereof communicating with the oil reservoir, and a generally open interior configured to receive the drive shaft therein;

a drive gear disposed in the interior of said oil pump body, and adapted for operable connection with the drive shaft for rotation therewith;

an idler gear rotatably supported in the interior of said oil pump body, and matingly engaging said drive gear for rotation therewith;

a cam drive gear disposed in the interior of said oil pump body, adapted for operable connection with the camshaft for rotation therewith, and matingly engaging said idler gear to axially rotate the camshaft; and a cam chest return gear rotatably supported in the interior of said oil pump body, and having a first portion thereof extending into a portion of the cam sump to draw oil therefrom, and a second portion thereof matingly engaging said idler gear at a location adjacent to said pump outlet portion of said oil passageway, such that oil drawn from the cam sump by said cam chest return gear is displaced between said cam chest return gear and said idler gear to flow the oil from the cam sump, through said oil passageway, and into the oil reservoir.

31. An oil pump kit as set forth in claim 30, wherein:

said oil passageway defines a first passageway; and said oil pump body includes a second passageway having a pump inlet portion thereof communicating with the oil reservoir, and an inlet end thereof communicating with a crankcase sump, and disposed adjacent to matingly engaged portions of said idler gear and said cam drive gear at a converging side thereof to convey oil from the crankcase sump between said idler gear and said cam drive gear to flow the oil from the crankcase sump, through said second passageway, and into the oil reservoir.

32. An oil pump kit as set forth in claim 31, wherein:

said pump inlet portion of said second passageway is disposed adjacent to said matingly engaged portions of said idler gear and said first cam drive gear at a diverging side thereof, whereby oil from the crankcase sump is also drawn around a portion of said idler gear and is displaced between said idler gear and said cam chest return gear to flow the oil through said first passageway, and into the oil reservoir.

33. An oil pump kit as set forth in claim 32, wherein:

said oil pump body includes an inlet pocket communicating with the oil reservoir, and disposed adjacent to matingly engaged portions of said second cam drive gear and said third cam drive gear at a converging side thereof to draw oil from the oil reservoir and displace the oil between said second and third cam drive gears to flow the oil through the engine.

34. An oil pump kit as set forth in claim 33, including:

a cover operably connected with said crankcase, and enclosing said oil pump body, and defining at least a portion of the cam sump.

35. An oil pump kit as set forth in claim 34, wherein:

said cover includes a bushing mounted on an interior portion thereof which rotatably supports therein an outer end of the camshaft.

36. An oil pump kit as set forth in claim 35, wherein:

said cam chest return gear includes a plurality of peripheral teeth; and said oil pump body includes a cam chest return gear recess, which is defined by a first sidewall, opens to an exterior face of said oil pump body, and closely receives a portion of said cam chest return gear therein; said first sidewall includes an open bottom portion through which said teeth on said second portion of said cam chest return gear protrude into the cam sump, such that said cam chest return gear picks up oil in the cam sump and positively displaces the same between said teeth of said cam chest return gear and said first sidewall of said cam chest return gear recess to remove oil directly from the cam sump without requiring an inlet port.

37. An oil pump kit as set forth in claim 36, including:

a divider plate disposed axially between said first cam drive gear and said second cam drive gear, and isolating said pocket from said cam sump scavenge passageway; and a body cover plate operably connected with said oil pump body and enclosing predetermined portions of said generally open exterior face of said oil pump body.

38. An oil pump kit as set forth in claim 37, wherein:

said oil pump body includes a drive gear recess, which communicates with said cam chest return gear recess, opens to said exterior face of said oil pump body, and receives said drive gear therein;

said cam chest return gear recess has a return portion extending between the diverging side of said matingly engaged portions of said cam chest return gear and said idler gear, and said open bottom of said first sidewall;

said idler gear and said cam chest return gear are configured to create a vacuum by the separation of said matingly engaged portions thereof; and including a seal extending around said drive gear recess, and positioned between said oil pump body and said cover, such that the vacuum created by the separation of said matingly engaged portions of said cam chest return gear and said idler gear communicates with spaces between said teeth on that portion of said cam chest return gear disposed in said return portion of said cam chest return gear recess to draw oil from the cam sump.

39. An oil pump kit as set forth in claim 38, including:

an idler gear shaft rotatably supporting said idler gear thereon and having one end thereof supported by said oil pump body, and an opposite end thereof extending into a mating aperture in said body cover plate; and a cam chest return gear shaft rotatably supporting said cam chest return gear thereon and having one end thereof supported by said oil pump body, and an opposite end thereof extending into a mating aperture in said body cover plate.

40. In a motorcycle engine having a crankcase, a drive shaft, a cam sump, and an oil reservoir, the improvement comprising:

an oil pump body operably connected with said crankcase, and including an oil passageway having a pump outlet portion thereof communicating with said oil reservoir, a generally open interior configured to receive said drive shaft therein, and a recess defined by a sidewall having an open bottom portion;

a drive gear disposed in the interior of said oil pump body, and operably connected with said drive shaft for rotation therewith;

an idler gear rotatably supported in the interior of said oil pump body, and matingly engaging said drive gear for rotation therewith; and a cam chest return gear closely received in said recess, and having a first portion thereof protruding through said open bottom portion of said sidewall, and into a portion of said cam sump to draw oil therefrom, and a second portion thereof matingly engaging said idler gear at a location adjacent to said pump outlet portion of said oil passageway, such that oil is drawn directly from said cam sump by said cam chest return gear without requiring an inlet port, and is displaced between said cam chest return gear and said idler gear to flow the oil directly from said cam sump, through said oil passageway, and into said oil reservoir.

41. A motorcycle engine as set forth in claim 40, wherein:

said oil pump body includes a drive gear recess, which communicates with said cam chest return gear recess, opens to said exterior face of said oil pump body, and receives said drive gear therein;

said cam chest return gear recess has a return portion extending between the diverging side of said matingly engaged portions of said cam chest return gear and said idler gear, and said open bottom of said first sidewall;

said idler gear and said cam chest return gear are configured to create a vacuum by the separation of said matingly engaged portions thereof; and including a seal extending around said drive gear recess, such that the vacuum created by the separation of said matingly engaged portions of said cam chest return gear and said idler gear communicates with spaces between said teeth on that portion of said cam chest return gear disposed in said return portion of said cam chest return gear recess to draw oil from said cam sump.

42. A motorcycle engine as set forth in claim 41, including:

a cover operably connected with said crankcase and enclosing said oil pump body; and wherein said seal is disposed between said oil pump body and said cover.

43. A motorcycle engine as set forth in claim 42, wherein:

said cover defines at least a portion of said cam sump.

44. A motorcycle engine as set forth in claim 43, wherein:

said oil pump body includes a generally open exterior face oriented away from said crankcase, and configured to insert said drive gear, said idler gear and said first, second and third cam drive gears therethrough into said interior of said oil pump body; and including a body cover plate operably connected with said oil pump body and enclosing predetermined portions of said generally open exterior face of said oil pump body.

45. In a motorcycle engine having a crankcase, a drive shaft, at least one camshaft, a crankcase sump, and an oil reservoir, the improvement of an integrated cam drive and oil pump assembly, comprising:

an oil pump body operably connected with said crankcase, and including an oil passageway having a pump outlet portion thereof communicating with said oil reservoir, and a generally open interior receiving said drive shaft therein;

a drive gear disposed in the interior of said oil pump body, and operably connected with said drive shaft for rotation therewith;

an idler gear rotatably supported in the interior of said oil pump body, and matingly engaging said drive gear for rotation therewith;

a first cam drive gear disposed in the interior of said oil pump body, being operably connected with said first camshaft for rotation therewith, and matingly engaging said idler gear to axially rotate said first camshaft; and wherein said pump outlet portion of said oil passageway is disposed adjacent to matingly engaged portions of said idler gear and said first cam drive gear at a converging side thereof to convey oil from the crankcase sump and displace the oil between said idler gear and said first cam drive gear to flow the oil from said crankcase sump, through said oil passageway, and into said oil reservoir.

46. A motorcycle engine as set forth in claim 45, wherein:

said oil passageway includes a pump inlet portion disposed adjacent to said matingly engaged portions of said idler gear and said first cam drive gear at a diverging side thereof, whereby oil from said crankcase sump is drawn around a portion of said idler gear and is displaced between said idler gear and said cam chest return gear to flow the oil into said oil reservoir.

47. A motorcycle engine as set forth in claim 46, including:

a cam sump;

a second passageway disposed in said oil pump body, and having a pump outlet portion communicating with said oil reservoir;

a second cam drive gear operably connected with said first camshaft at a location spaced axially apart from said first cam drive gear, and rotating with said first camshaft;

a third cam drive gear operably connected with said second camshaft for rotation therewith, and matingly engaging said second cam drive gear to axially rotate said second camshaft; and a cam chest return gear rotatably supported in the interior of said oil pump body, and having a first portion thereof extending into a portion of said cam sump to draw oil therefrom, and a second portion thereof matingly engaging said idler gear at a location adjacent to said pump outlet portion of said second passageway, such that oil drawn from said cam sump by said cam chest return gear is displaced between said cam chest return gear and said idler gear to flow the oil from said cam sump, through said second passageway, and into said oil reservoir.

48. A motorcycle engine as set forth in claim 47, including:

a divider plate disposed axially between said first cam drive gear and said second cam drive gear, and isolating said pocket from said cam sump scavenge passageway; and wherein said pocket defines an inlet pocket; and including an outlet pocket disposed adjacent to said matingly engaged portions of said second cam drive gear and said third cam drive gear at a diverging side thereof.

49. In a motorcycle engine having a crankcase, a drive shaft, first and second camshafts, a cam sump, and an oil reservoir, the improvement of an integrated cam drive and oil pump assembly, comprising:

an oil pump body operably connected with said crankcase, and including an oil passageway communicating with said oil reservoir, and a generally open interior receiving said drive shaft therein;

a drive gear disposed in the interior of said oil pump body, and operably connected with said drive shaft for rotation therewith;

an idler gear rotatably supported in the interior of said oil pump body, and matingly engaging said drive gear for rotation therewith;

a first cam drive gear disposed in the interior of said oil pump body, being operably connected with said first camshaft for rotation therewith, and matingly engaging said idler gear to axially rotate said first camshaft;

a second cam drive gear operably connected with said first camshaft at a location spaced axially apart from said first cam drive gear, and rotating with said first camshaft;

a third cam drive gear operably connected with said second camshaft for rotation therewith, and matingly engaging said second cam drive gear to axially rotate said second camshaft; and wherein said oil pump body includes an inlet pocket communicating with said oil reservoir, and disposed adjacent to matingly engaged portions of said second cam drive gear and said third cam drive gear at a diverging side thereof to draw oil from said oil reservoir and displace the oil between said second and third cam drive gears to flow the oil through said engine.

50. In a method for making a motorcycle engine of the type having a crankcase, a drive shaft, first and second camshafts, a cam sump, and an oil reservoir, the improvement comprising:

providing an oil pump body with an oil passageway having a pump outlet portion thereof, and a generally open interior;

operably connecting the oil pump body with the crankcase, such that the drive shaft is positioned in the interior of the oil pump body;

communicating the pump outlet portion of the oil passageway with the oil reservoir;

providing a drive gear;

mounting the drive gear in the interior of the oil pump body, and operably connecting the same with the drive shaft for rotation therewith;

providing an idler gear;

rotatably supporting the idler gear in the interior of the oil pump body, and matingly engaging the same with the drive gear for rotation therewith;

providing a first cam drive gear;

operably connecting the first cam drive gear with the first camshaft for rotation therewith in the interior of the oil pump body, and matingly engaging the first cam drive gear with the idler gear to axially rotate the first camshaft;

providing a second cam drive gear;

operably connecting the second cam drive gear with the first camshaft at a location spaced axially apart from the first cam drive gear for rotation with the first camshaft;

providing a third cam drive gear;

operably connecting the third cam drive gear with the second camshaft for rotation therewith in the interior of the oil pump body, and matingly engaging the third cam drive gear with the second cam drive gear to axially rotate the second camshaft;

providing a cam chest return gear; and rotatably supporting the cam chest return gear in the interior of the oil pump body, and extending a first portion thereof into a portion of said cam sump to draw oil therefrom, and positioning a second portion thereof in mating engagement with the idler gear at a location adjacent to the pump outlet portion of the oil passageway, such that oil drawn from the cam sump by the cam chest return gear is displaced between the cam chest return gear and the idler gear to flow the oil from the cam sump, through the oil passageway, and into the oil reservoir.

* * * * *